US005609424A

United States Patent [19]

Sakuragi et al.

[11] Patent Number: 5,609,424

[45] Date of Patent: Mar. 11, 1997

[54] TAPE-SHAPED LABEL PRODUCING DEVICE HAVING INPUT INSTRUCTING MESSAGES

[75] Inventors: Shoji Sakuragi; Hideo Ueno, both of Nagoya; Shiro Yamada, Kasugai; Mayumi Nishio; Kazuhisa Hirono, both of Nagoya; Kazumi Kanda, Gifu-ken; Sachiyo Nakahigashi, Nagoya; Sachiko Nakagawa, Kariya; Akihiro Sawada, Nagoya, all of Japan

[73] Assignee: Brother Kogyo Kabushiki Kaisha, Nagoya, Japan

[21] Appl. No.: 503,685

[22] Filed: Jul. 18, 1995

[30] Foreign Application Priority Data

Jul. 18, 1994 [JP] Japan ..... 6-188835
Jul. 18, 1994 [JP] Japan ..... 6-188836
Jul. 18, 1994 [JP] Japan ..... 6-188837

[51] Int. Cl.[6] ..... B41J 11/42

[52] U.S. Cl. ..... 400/61; 400/76; 400/615.2

[58] Field of Search ..... 400/61, 76, 615.2, 400/586, 63, 64, 65, 70, 62

[56] References Cited

U.S. PATENT DOCUMENTS 5,066,152 11/1991 Kuzuya et al. .

FOREIGN PATENT DOCUMENTS 2-106555 4/1990 Japan .

*Primary Examiner*—John S. Hilten
*Attorney, Agent, or Firm*—Oliff & Berridge

[57] ABSTRACT

When a label name is selected, a plurality of prompt associated with the selected label name are displayed one after the other on a display so that a user can easily know what text data needs to be inputted. The text memory stores text data inputted as prompted by each of the plurality of prompts associated with the selected label name. Also the text memory retrieves, from a registration layout information memory, print layout information for printing the inputted text data. The print mechanism prints the text data stored in the text memory on a tape based on the print layout information. In this way, a label printed with the text data, that can be adhered to the binding of files and the like, can be produced quickly and easily.

12 Claims, 25 Drawing Sheets

FIG. 4

43

| | | |
|---|---|---|
| LABEL INDEX TABLE | −1 | LEADING ADDRESS OF "Reg. File Retrieval" ← LP |
| | 0 | LEADING ADDRESS OF "Video VHS Tape" |
| | 1 | LEADING ADDRESS OF "Video 8mm & Hi 8 Tape" |
| | 2 | LEADING ADDRESS OF "Video 8mm & Hi 8 Case" |
| | 3 | LEADING ADDRESS OF "Video VHS−C Tape" |
| | 4 | LEADING ADDRESS OF "Video VHS−C Case" |
| | 5 | LEADING ADDRESS OF "Audio Tape Cassette" |
| | | ⋮ |
| LABEL CHARA. INF. TABLE | | CHARA. DATA FOR "Video VHS Tape" |
| | | CHARA. DATA FOR "Video 8mm & Hi 8 Tape" |
| | | CHARA. DATA FOR "Video 8mm & Hi 8 Case" |
| | | CHARA. DATA FOR "Video VHS−C Tape" |
| | | CHARA. DATA FOR "Video VHS−C Case" |
| | | ⋮ |
| LABEL NAME TABLE | | DISPLAY DATA OF "Reg. File Retrieval" |
| | | DISPLAY DATA OF "Video VHS Tape" |
| | | DISPLAY DATA OF "Video 8mm & Hi 8 Tape" |
| | | DISPLAY DATA OF "Video 8mm & Hi 8 Case" |
| | | DISPLAY DATA OF "Video VHS−C Tape" |
| | | DISPLAY DATA OF "Video VHS−C Case" |
| | | DISPLAY DATA OF "Audio Tape Cassette Tape" |
| | | ⋮ |
| PROMPT TABLE | | DISPLAY DATA OR A MESSAGE "SYMBOL ?" |
| | | DISPLAY DATA OR A MESSAGE "TITLE ?" |
| | | DISPLAY DATA OR A MESSAGE "COMMENS ?" |
| | | DISPLAY DATA OR A MESSAGE "STANDARD ?" |
| | | DISPLAY DATA OR A MESSAGE "REC. DATE ?" |
| | | DISPLAY DATA OR A MESSAGE " " |
| | | ⋮ |

FIG. 6

| LABEL NO. | STANDARD LABEL NAME | PROMPT | OPTIMAL TAPE WIDTH | | | | |
|---|---|---|---|---|---|---|---|
| | | | 6 | 9 | 12 | 18 | 24 |
| −1 | Reg. File Retrieval | TEXT DATA | SET TAPE WIDTH | | | | |
| 0 | Video VHS Tape | 1. SYMBOL ? 2. TITLE ?<br>3. COMMENT ? 4. REC. TIME ?<br>5. STANDARD ? 6. DATE RECORDED ? | | | | ○ | |
| 1 | Video 8mm & Hi 8 Tape | 1. SYMBOL ? 2.TITLE ?<br>3. COMMENTS ? | | ○ | | | |
| 2 | Video 8mm & Hi 8 Case | 1. SYMBOL ? 2. TITLE ?<br>3. COMMENT ? 4. REC. TIME ?<br>5. STANDARD ? 6. DATE RECORDED ? | | | ○ | | |
| 3 | Video VHS−C Tape | 1. SYMBOL ? 2.TITLE ? | | | ○ | | |
| 4 | Video VHS−C Case | 1. SYMBOL ? 2. TITLE ?<br>3. COMMENT ? 4. REC. TIME ?<br>5. STANDARD ? 6. DATE RECORDED ? | | | | ○ | |
| 5 | Audio Tape Cassette | 1. SYMBOL ? 2.TITLE ?<br>3. COMMENT ? | ○ | | | | |
| 6 | Audio Cassette Case | 1. SYMBOL ? 2.TITLE ?<br>3. COMMENT ? | | | ○ | | |
| 7 | Audio DAT Tape | 1. SYMBOL ? 2.TITLE ? | ○ | | | | |
| 8 | Audio DAT Case | 1. SYMBOL ? 2.TITLE ? | | | ○ | | |
| 9 | Large Name Tag | 1. SYMBOL ? 2.TITLE ?<br>3. COMMENT ? | | | | | ○ |
| 10 | Small Name Tag | 1. SYMBOL ? 2.TITLE ? | | | | | ○ |
| 11 | Large Manag. Equipment | 1. NAME OF EQUIP ? 2. MANAG. NO. ?<br>3. MANAG. AUTORITY ? 4. COMP. NAME ? | | | | | ○ |
| 12 | Small Manag. Equipment | 1. NAME OF EQUIP ? 2. MANAG. NO. ?<br>3. MANAG. AUTORITY ? | | | ○ | | |
| ⋮ | ⋮ | ⋮ | | | | | |

TAPE-SHAPED LABEL PRODUCING DEVICE HAVING INPUT INSTRUCTING MESSAGES

BACKGROUND OF THE INVENTION

1. Field of the Invention

The present invention relates to a tape printer or other tape-shaped label producing device capable of producing a plurality of tape-shaped labels in a predetermined format but each label being printed with different characters.

2. Description of the Related Art

U.S. Pat. No. 5,066,152 describes a tape printer including a keyboard, a display, and a print mechanism having a thermal head. Tape-shaped labels printed with characters, such as alphanumeric characters and symbols, can be produced using the tape printer. To produce labels, ink from an ink ribbon is transferred to, for example, 9 mm, 12 mm, or 24 mm wide tapes which serve as the medium for printing. These labels can be adhered to the binding of files and the like to facilitate identifying the contents of the files.

The tape printer can produce labels in sizes suitable for many other uses as well. For example, to organize and put order to a collection of items, such as video cassettes, audio cassettes, or books, labels can be produced to adhere to the individual items of the collection, such as to video cassettes or their cases, to audio cassettes or their cases, or to books. Also, labels can be produced for adhering to personal items such as writing materials like notebooks and pens. Labels for such writing materials could be produced to include such information as item owner's name, school name, school year, and address.

Labels for organizing a library or private collection of books need to show several categories of information, such as book title, author, and purchase date. Layout data which indicates in what arrangement text data will be printed is required to print the text data inputted for each category. The layout data is registered as file data. To print a label, first the user retrieves a display image of the registered layout file and then inputs text data for the subject book using editing operations. Then the registered file and the inputted text data are printed to form a tape-shaped label. These editing end printing operations ere repeated to produce a label for adhering to each of the books in the library or collection.

However, the tape printer can not print a desired label if the desired label requires a larger width tape then the tape housed in the tape cassette loaded in the printing mechanism. This situation arises with labels having a layout for inputting e great deal of text data. When the desired label is too large to print on the tape in the mounted tape cassette, an error message is generated when printing is attempted. On the other hand, when the tape in the mounted tape cassette has a width greater than needed to print the selected label, no error message will be generated, but the user must cut off the excess width of the printed label using scissors. This adds to the operations needed for a user to produce a desired label.

When producing labels for organizing a library or private collection of books, after printing a label for one book, all text data inputted in categories such as the title and author must be erased before inputting text data for the next book. Then the text data for the next book is newly inputted to all the different categories. This complicates editing operations.

It is also conceivable to preregister a master file including only layout information for printing the text data, but without any text data. The master file can be retrieved on the display, and text data inputted while viewing the display. However, such a master file would appear confusing to an operator because which text data should be inputted to which categories and at which data inputting positions would not be apparent.

Also, when a user wants to print a label with a layout he or she has previously created and registered, the label name by itself will not provide the user enough information to tell how wide the label will be when printed out. Because the user will not know how wide the tape in the tape cassette needs to be, he or she will be at a loss to prevent error messages about improper width tapes being mounted in the printing mechanism from being displayed on the display. This can make producing a label a frustrating experience. The user can always use a tape cassette housing the widest tape, but this requires that the user cut off excess tape width of printed labels, which complicates the label producing process and also wastes tape,

SUMMARY OF THE INVENTION

It is an object of the present invention to provide a tape printer capable of quickly and easily printing a plurality of tape-shaped labels based on desired layout information set and registered by input by a user.

It is another object of the present invention to provide a tape printer which a user can easily and quickly produce labels using tape with width appropriate for the selected label.

To achieve the above and other objects, there is provided, according to one aspect of the invention, a tape-shaped label producing device including input means for inputting a variety of data and commands, display means for displaying images, print means for printing on a tape-shape printing medium, and control means for controlling the input means, the display means, and the print means, wherein layout information memory is provided for storing (a) layout information inputted through the input means, the layout information containing a plurality of label names, each label name having a plurality of blanks into which a plurality of pieces of information are insertable;

(b) display information regarding prompts to be displayed on the display means for prompting an operator to insert the plurality of pieces of information; and (c) print layout information regarding a print layout of text data inputted in association with the prompts.

Display control means ie further provided for displaying on the display means, based on commands inputted through the input means and based on the display information and the print layout information stored in the layout information memory, the plurality of label names one after the other and for displaying on the display means the plurality of prompts associated with a selected label name. The display control means includes indicating means for indicating a portion of the display means into which each of the plurality of pieces of information is inserted following the prompt.

It is preferable that the layout information memory store default information relative to a preselected prompt. The display control means displays on the display means the default information in the portion of the display means following the preselected prompt.

The indicating means can be a cursor displayed on the display means. While a prompt and the portion of the display means are displayed on the display means, the display control means displays the cursor on the display means at a predetermined portion of the display means.

According to another aspect of the invention, the label producing device further includes a text memory in which stored are text data inputted through the input means in association with each prompt displayed with respect to the selected label name. The print layout information relevant to the text data is retrieved from the layout information memory and stored in the text memory in association with the text data.

Tape discriminating means may further be provided for discriminating tape-shape printing mediums having different widths. The registration layout information includes information on a width of the tape-shaped printing medium most appropriate for each of the plurality of label names.

The display means has a first display portion and a second display portion separate from the first display portion. The display control means displays each of the plurality of prompts associated with the selected label at the first display portion of the display means, and text data associated with each prompt at the second display portion of the display means upon retrieving the text data from the text memory.

According to still another aspect of the invention, layout information memory may further store tape width information on a width of the tape-shaped printing medium most appropriate for each of the plurality of label names. Also, the display control means may further include indicating means for indicating a portion of the display means into which each of the plurality of pieces of information is insertable following the prompt.

There may be further provided mounting means for mounting the tape-shape printing medium, and tape width detection means for detecting width of the tape-shape printing medium mounted in the mounting means. The display control means selectively displays on the display means only label names appropriate for the tape width detected by the tape width detection means.

A registration layout information memory may be provided for storing registration layout information which is inputted from the input means and which corresponds to the display information and the print layout information stored in the layout information memory.

There may be further provided selection prevention means for preventing, while the label name is displayed on the display means, selection of a label name from the registration layout information memory when the tape width detected by the tape width detection means is not appropriate for the label name. The display control means displays, on the display means, tape width information stored in association with the label name when the label name is prevented form being selected.

BRIEF DESCRIPTION OF THE DRAWINGS

The above and other objects, features and advantages of the invention will become more apparent from reading the following description of the preferred embodiment taken in connection with the accompanying drawings which

FIG. 4 schematically shows information in a label index table, a label characteristic information table, a label name table, and a prompt table stored in a ROM of the tape printer;

FIG. 6 shows a list of fixed label names and associated information:

DETAILED DESCRIPTION OF THE PREFERRED EMBODIMENT

Figure 1:
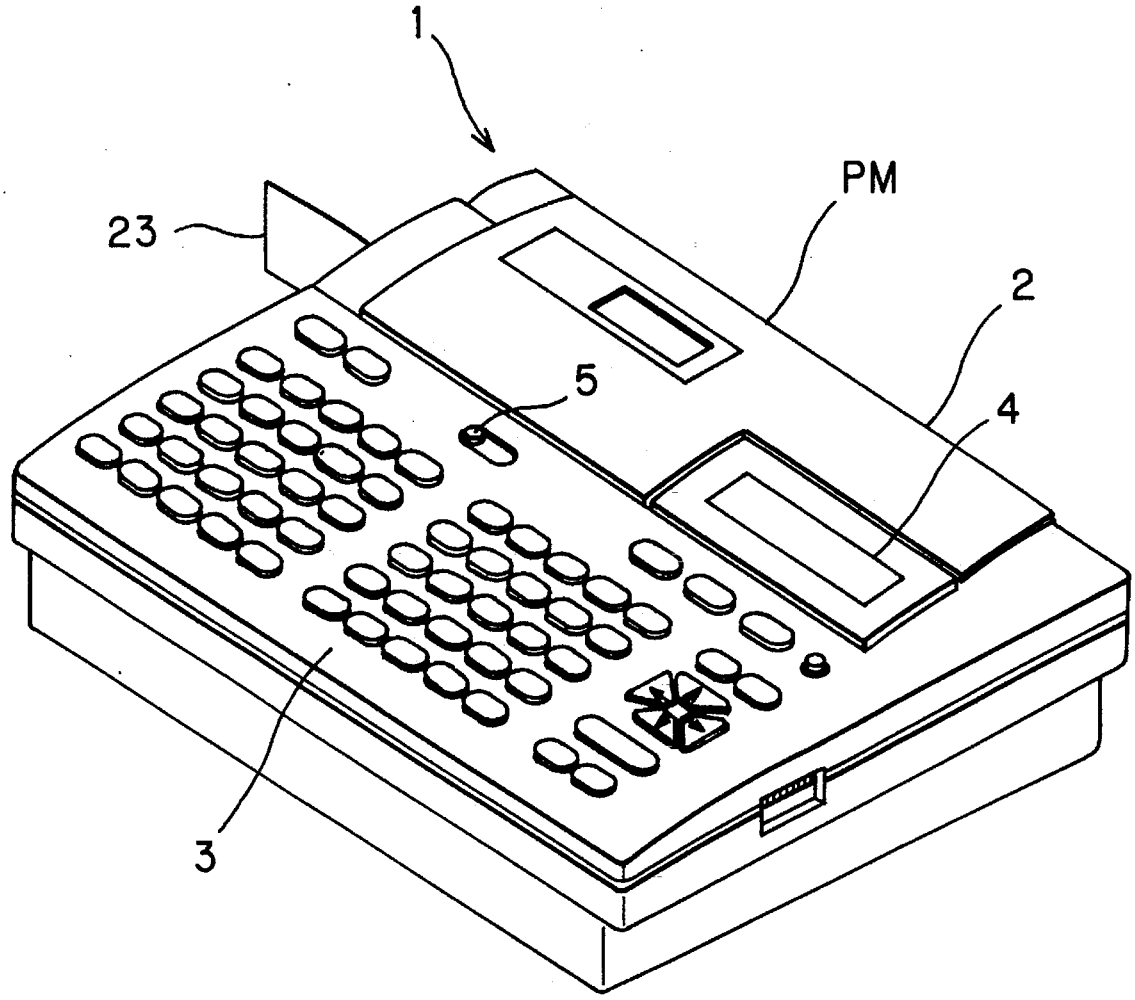
FIG. 1 is a perspective view showing a tape printer according to an embodiment of the present invention.

A tape printer according to a preferred embodiment of the present invention will be described while referring to the accompanying drawings wherein like parts and components are designated by the same reference numerals to avoid duplicating description.

The present embodiment describes the present invention applied to a tape printer for producing tape-shaped labels. The labels are produced by printing a plurality of characters, such as alphanumeric characters, symbols, Japanese kana, and Japanese kanji on a laminate tape, i.e., print tape, which serves a printing medium. As shown in FIG. 1, a tape printer 1 includes a main frame 2. A keyboard 3 serving as an input means is provided to the front half of the main frame 2. A display 4, such as a liquid crystal display, capable of displaying two lines of inputted characters and symbols is provided to the main frame 2 at the rear-left of the keyboard 3. A thermal-type printing mechanism PM is provided in the main frame 2 at the rear-right of the keyboard 3. The keyboard 3 includes an operation knob 5 for opening a cover case of the printing mechanism PM.

The keyboard 3 includes various keys such as character keys for inputting alphanumeric characters and symbols to be printed; a space key; a return key; cursor move keys for moving a cursor K horizontally and vertically across the display 4; a key for producing, in predetermined layouts, labels suitable for adhering to video tapes, audio tapes, or their respective cases; editing keys such as enter keys and delete keys; a print key for commanding printing operations to start; and a power key for turning power ON and OFF.

Figure 2:
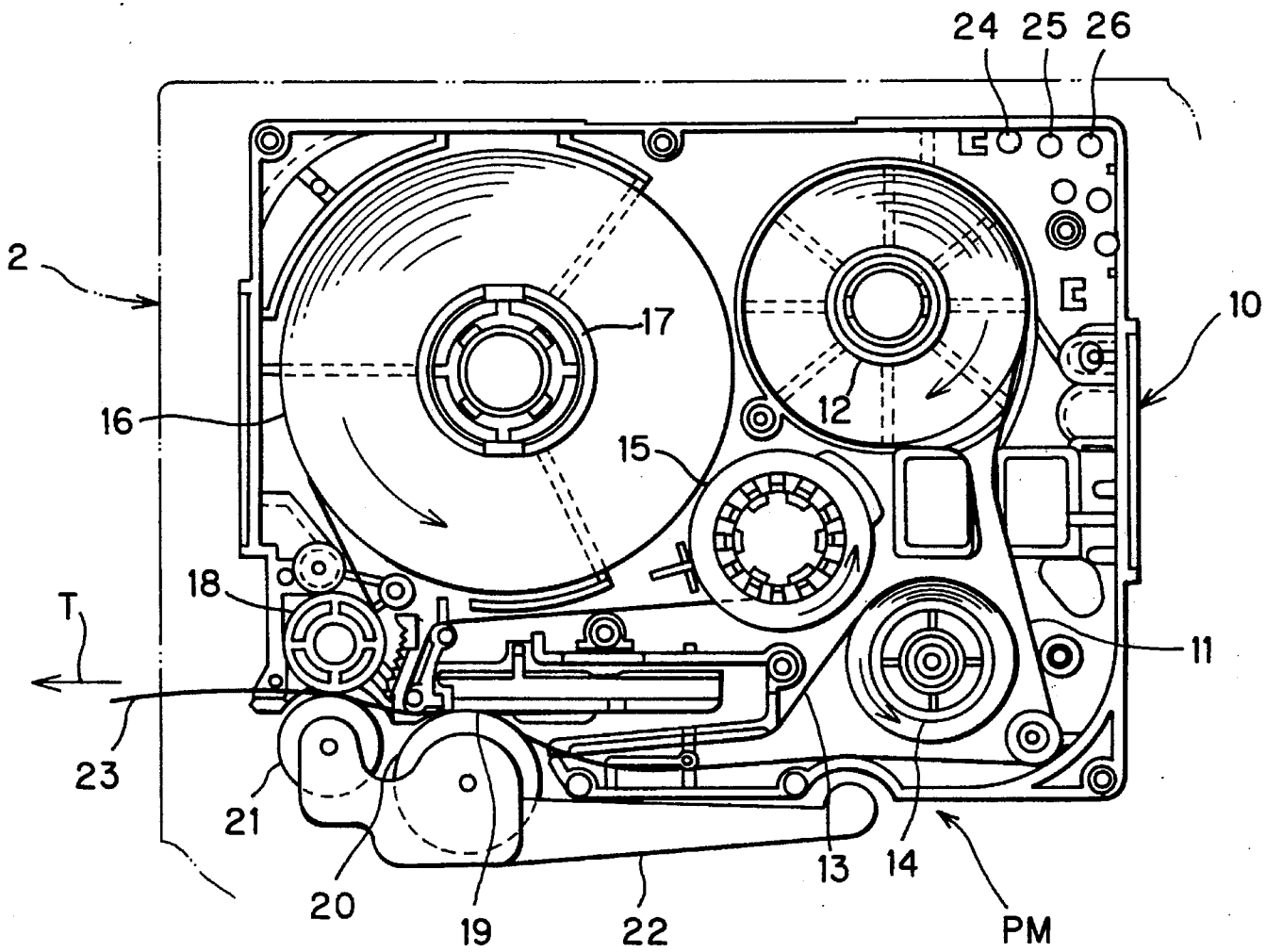
FIG. 2 is a bird's eye view showing a tape cassette mounted in the tape printer of FIG. 1.

Next, an explanation of the printing mechanism PM, which serves as a printing means, will be provided while referring to FIG. 2.

A freely detachable rectangular-shaped tape cassette 10 is loaded in the printing mechanism PM. A tape spool 12, a ribbon spool 14, a take-up spool 15, a supply spool 17, and a joining roller 18 are provided to the tape cassette 10 so as to be freely rotatable. A laminate tape 11, serving as the medium to be printed on, is provided wrapped around the tape spool 12. An ink ribbon 13 is provided wrapped around the ribbon spool 14 and is taken up by the take-up spool 15. A two-sided tape 16 with a peel-away sheet attached to one surface and with the same width as the laminate tape 11 is provided wrapped around the supply spool 17 so that its peel-away sheet faces outward. In cooperation with a platen roller 20, which will be described later, the joining roller 18 applies pressure to the laminate tape 11 and the two-sided tape 16 to join the two together.

A thermal head 19 is disposed at the position where the laminate tape 11 and the ink ribbon 13 overlap. A platen roller 20 is supported by a roller supporting body 22 mounted to the main frame 2 so as to be freely pivotable. The platen roller 20 is supported so as to be rotatable about its axes of rotation in opposition to the thermal head 19. The platen roller 20 presses the laminate tape 11 and the ink ribbon 13 against the thermal head 19. A feed roller 21 is also supported so as to be rotatable about its axes of rotation on the roller supporting body 22. The feed roller 21 presses the laminate tape 11 and the two-sided tape 16 against the joining roller 18 to produce a tape-shaped label 23. The thermal head 19 is provided with 128 vertically aligned thermal elements.

Figure 3:
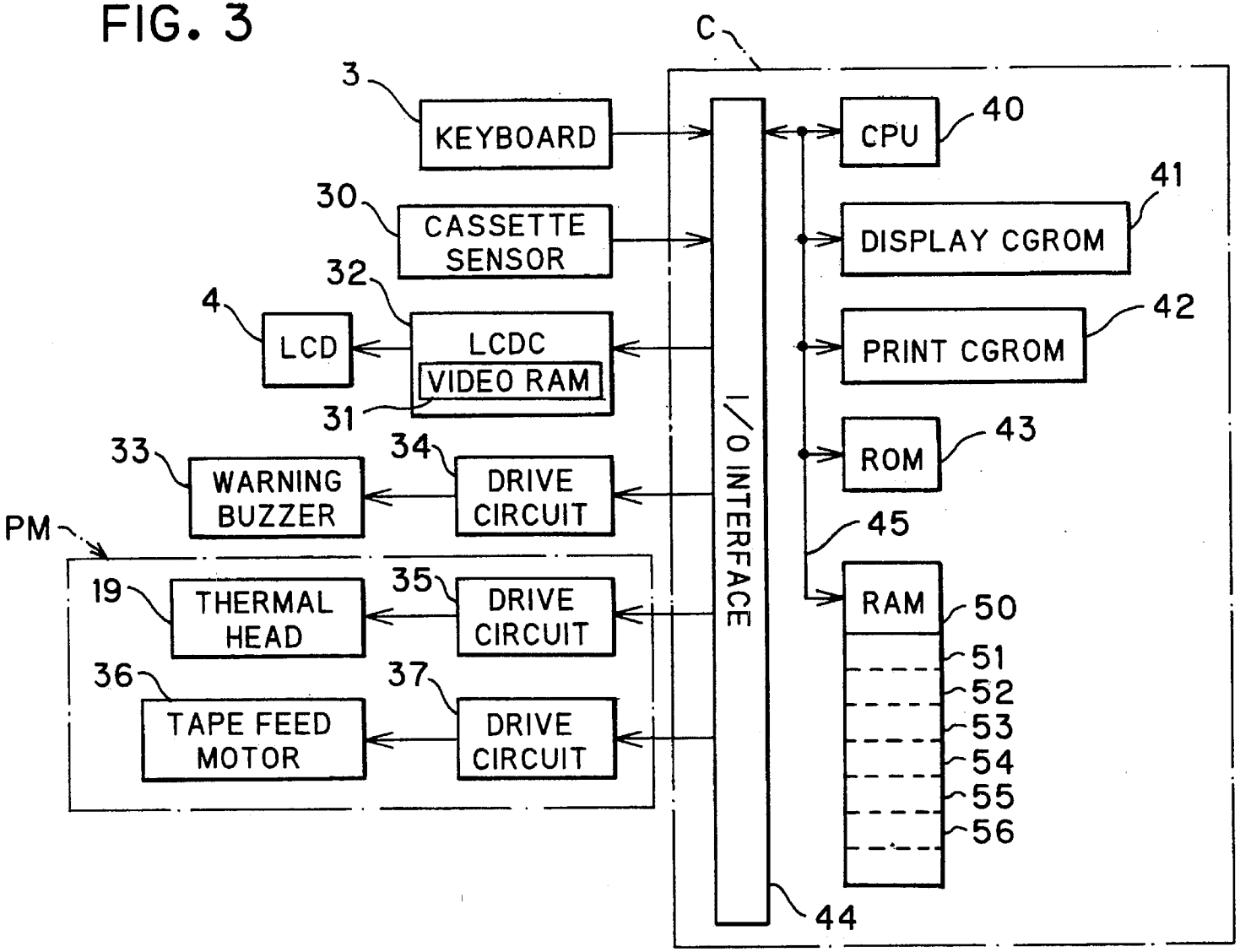
FIG. 3 is a block diagram schematically showing configuration of electrical components of the tape printer.

A tape feed motor 36 shown in FIG. 3 is provided to rotate in a predetermined direction when driven. Rotation of the tape feed motor 36 drives the joining roller 18 and the take-up spool 15 to rotate in synchronization in the predetermined direction. While the joining roller 18 and the take-up spool 15 are rotated in this way, the plurality of thermal elements of the thermal head 19 are energized to print mirror images of characters and symbols out of plurality of dot rows to the rear surface of the laminate tape 11. A tape-shaped label 23 is produced when the two-sided tape 16 is joined to the rear surface of the laminate tape 11. The tape-shaped label 23 is fed in a tape feed direction T out of the main frame 2 as shown in FIGS. 1 and 2. Details of the printing mechanism PM are described in Japanese Patent Application Kokai No. HEI-2-106555.

Five types of tape cassettes 10 are prepared. The laminate tape 11 wrapped around the tape spool 12 in each type of tape cassette 10 has a different tape width, for example, 6 mm, 9 mm, 12 mm, 18 mm, or 24 mm width tapes. The mechanism for detecting the width of the laminate tape 11 housed in each tape cassette 10 includes three detection housed 24 to 26, which are formed to the base of the tape cassette 10 as shown in FIG. 2, and a cassette sensor 30, which is attached to the surface of the main frame 2 supporting the lower surface of the tape cassette 10 as shown in FIG. 3. The width of the laminate tape 11 housed in the tape cassette 10 determines which, if any, of the detection holes 24 through 26 are covered up. The cassette sensor 30 outputs information on the tape cassette 10, such as the width of the housed laminate tape 11, the type of laminate tape 11, and the like, as detected by the combination of covered holes.

Next, an explanation of the configuration of the control system of the tape printer 1 will be provided while referring to FIG. 3. A control device C is provided with an input/output interface 44 to which are individually connected the keyboard 3; the cassette sensor 30; a display controller (LCDC) 32 having a video RAM 30 for outputting display data to the display 4; a drive circuit 34 for driving a warning buzzer 33; a drive circuit 35 for driving the thermal head 19; and a drive circuit 37 for driving the tape feed motor 36.

The control device C also includes a CPU 40; a display character generator ROM (display CGROM) 41; a print character generator ROM (print CGROM) 42; a ROM 43; and a RAM 50. All the Components of the control device C are interconnected via a bus 45, such as a data bus.

The display character generator ROM 41 stores dot pattern data for displaying each of a plurality of symbols and alphanumeric characters at a predetermined size. The print character generator R0M 42 stores dot pattern data for printing each of the plurality of symbols and alphanumeric characters. A plurality of sets of dot pattern data for each character, differing in print size, are stored for each of a plurality of fonts in correspondence with code data.

The ROM 43 stores various routines, including a display drive routine for controlling the display controller 32 in correspondence with %he code data of characters, such as characters, numbers, and symbols, inputted through the keyboard 3; and a print drive routine for printing by serially transmitting, to the thermal head 19 and to the tape feed motor 36, dot pattern data for each row of dote to be printed. The ROM 43 also stores several routines specific to the present invention, such as a text input routine, a standard label producing routine, a label name selection routine, a standard label data input routine, and a text registration routine.

The tape printer 1 is capable of producing a variety of labels such as a "Video VHS Tape" label for adhering to a VHS video tape cassette; a "Video 8 mm & Hi 8 tape" label for adhering to an 8 mm video tape cassette; a "Video 8 mm & Hi 8 Case" label for adhering to the case of an 8 mm video tape cassette; "Video VHS-C Tape" label for adhering to a compact VHS video tape cassette; a "Video VHS-C Case" label for adhering to the case of a compact VHS video tape cassette; and an "Audio Tape Cassette" label for adhering to an audio tape cassette. Further, the tape printer 1 is capable of producing "Registered File Retrieval" labels that a user registers after creating the label by inputting various settings.

As shown in FIG. 4. the ROM 43 is provided with a label index table, a label characteristic information table, a label name table, and a prompt table. The label index table stores the leading address in the label characteristic information table and in the label name table for each of the different labels the tape printer i can produce. The label characteristic information table stores characteristic data for each label. The label name table stores display data for displaying each label name. The prompt table stores display data for a plurality of prompts provided in association with each label name. It is noted that in the label index table, each of the plurality of label names shown are stored in association with its own label number "–1," "0," "1," "2," and so on. The plurality of label names fixedly prestored in the ROM 43 will be referred to as fixed label names hereinafter to distinguish them from registered label names.

Figure 5:
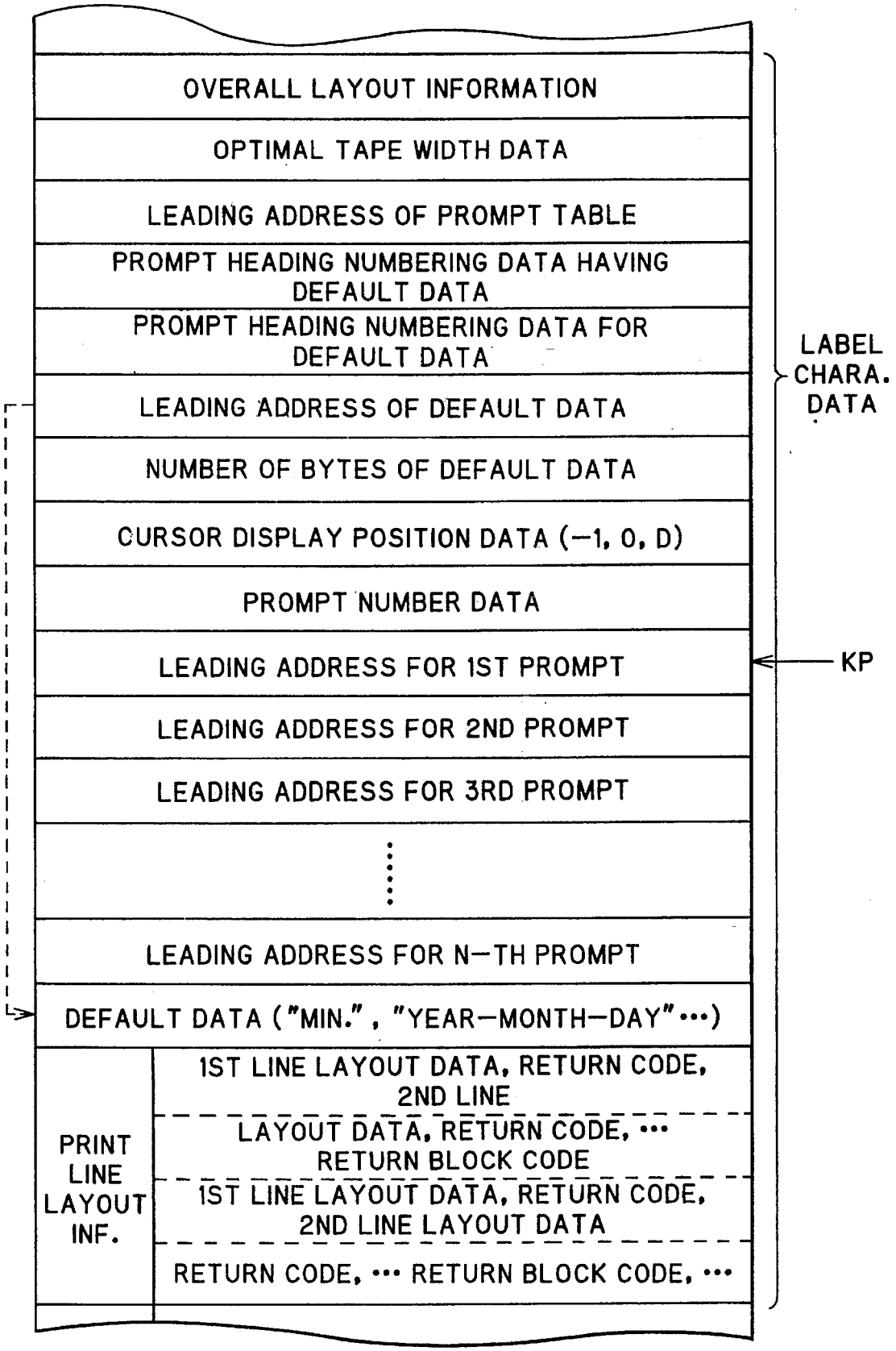
FIG. 5 shows information stored in association with characteristic data on each label type in the label characteristic information table of the ROM.
Figure 7:
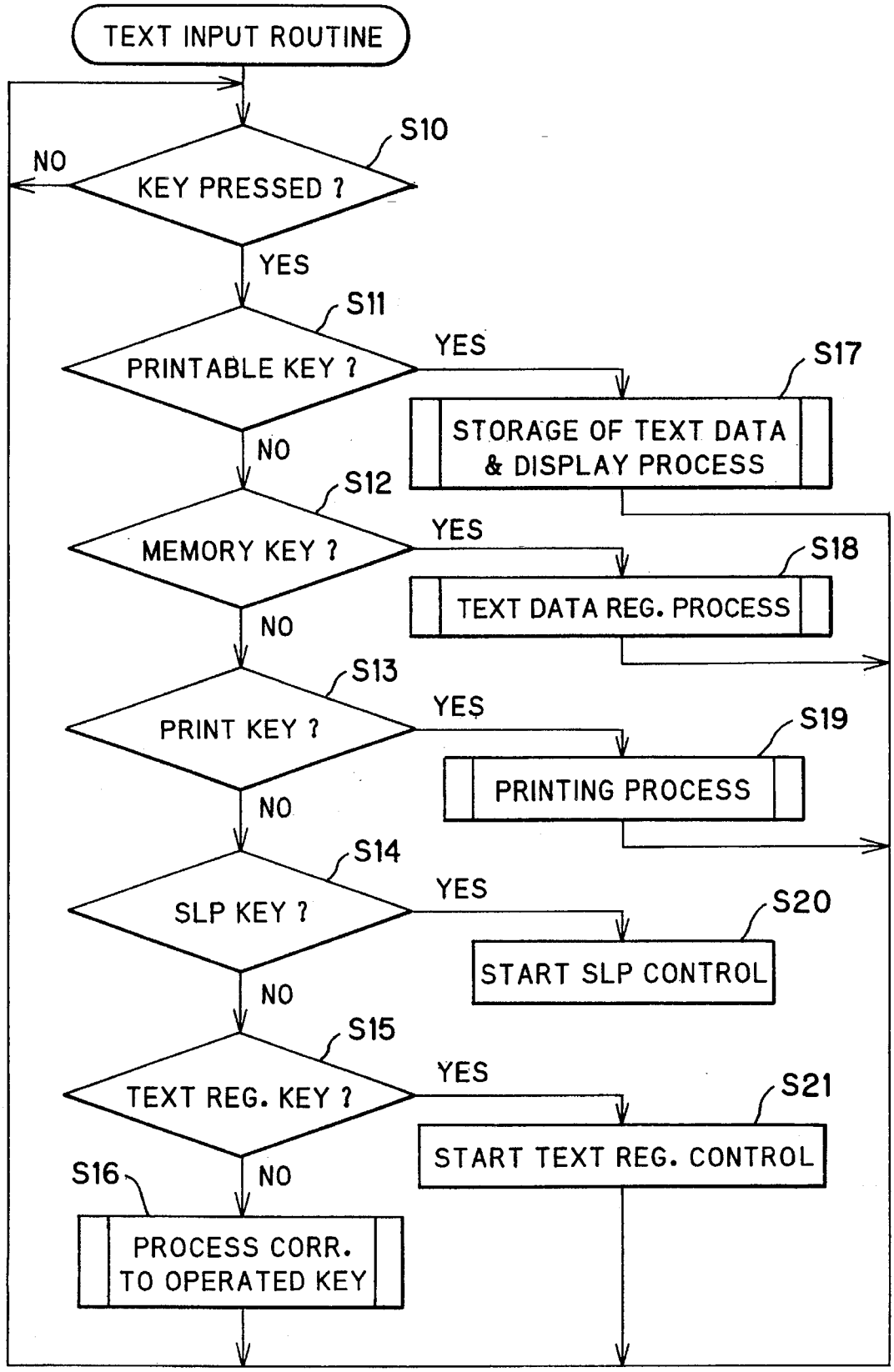
FIG. 7 shows a flowchart schematically representing a text input routine of the tape printer.

Further, as shown in FIG. 5, label characteristic data for each label includes overall layout information relating to printing the corresponding label; optimal tape width data indicating optimum width of tape on which the corresponding label should be printed; prompt heading number data having default data such as specific characters and symbols, for example, "Min." and "Date Month Year," preset for printing; prompt heading numbering data having default data; leading address of default data; the number of bytes of default data; and cursor display position data. The label characteristic data also includes prompt number data, the leading address for each prompt in the prompt table; a plurality of default data groups, the leading addressee of which are included in the above-described prompt heading number data; and print line layout information for determining positioning of data inputted for printing on a label. Line layout data for each line of each block is separated in the print line layout information by line return codes and block return codes. It should be noted that three kinds of cursor display position data are possible; "–1" which indicates the last position of a line; "0" which indicates the first position of a line; and a digit D which indicates a column position on the line.

Next, an explanation of several fixed label names for labels that can be produced by the tape printer 1 will be provided while referring to FIG. 6.

As will be described later, the "Registered File Retrieval," which is the name of a label file produced and registered by a user, has a label number of "–1," text data is displayed as the prompt, and the optimum tape width is a set tape width.

The fixed label name "Video VHS Tape" has the label number "0," "Video 8 mm & Hi Case" has the label number "2," and "Video VHS-C Case" has the label number "4." These three fixed label names, i e., with label numbers "0," "2," and "4," are stored in correspondence with six prompts: a first prompt of "Symbol?"; a second prompt of "Title?"; a third prompt of "Comment?"; a fourth prompt of "Recording Time"; a fifth prompt of "Standard?"; and a sixth prompt of "Date Recorded?" The optimal tape width for these three fixed label names are "18 mm" or "12 mm."

The fixed label name "Video 8 mm & Hi 8 Tape" has the label number "1," "Audio Cassette Tape" has the label number "5," "Audio DAT Tape" has the label number "7." "Large Name Tag" has the label number "9," "Small Name Tag" has the label number "10," "Large Management Equipment" has the label number "11," and "Small Management Equipment" has the label number "12." These fixed label names are stored in correspondence with the prompts and the optimal tape widths indicated in FIG. 6.

Although not shown in the drawings, the tape printer 1 is capable of producing a variety of other fixed label names, such as a "Floppy 3.5 Inch" label, a "Floppy 5 Inch" label, a "Price Card" label, a "Document Name" label, and an "Letter Address" label.

As shown in FIG. 3, the RAM 50 is divided into several memories and buffers including a text memory 51 storing code data of characters, that were inputted from the keyboard 3 with the text input routine, and text data, that was inputted from the keyboard 3 as prompted by prompts displayed by the standard label data input routine; an overall layout information memory 52 storing overall layout information of the selected label name; a pointer memory 53; a tape information memory 54 storing tape width data of the laminate tape 11 of the tape cassette 10 loaded in the printing mechanism PM; and a registration file memory 55 storing registered files registered by a user. The pointer memory 53 stores a pointer value LP and an prompt pointer value KP. As shown in FIG. 4, the pointer value LP serially indicates label names stored in the label index table. As shown in FIG. 6, the prompt pointer value KP serially indicates the prompts stored in the prompt table. The RAM 50 additionally includes a print data buffer 56 storing developed dot pattern data in correspondence with character codes stored in the text memory 51 and other buffers and memories temporarily storing calculation results of calculations made in the CPU 40.

Next, an explanation of the text input routine, the standard label production routine, the label name selection routine, the standard label data input routine, and a text registration routine performed in the control device C of the tape printer 1 will be provided while referring to the schematic flowcharts shown in FIGS. 7 through 21. Individual steps in the routines will be indicated as Si (wherein i=10, 11, 12, and so on).

The text input routine for normal input of text data is started up when the power source is turned on by operating the power key on the keyboard 3. A text data input image is displayed on the display 4. When a printable key such as a character key, a numeric key, a symbol key, a line return key, a block return key, or key other than an editing key is depressed (i.e., S10 and S11 are YES), the code data corresponding to the depressed key is stored in the text memory 51 as text data and the character or symbol corresponding to the depressed key is displayed on the display 4 in S17. The routine then returns to S10.

When the memory key is depressed (i.e., S10 is YES, S11 is NO, and S12 is YES), registration operations for registering the text data stored in the text memory 51 into the registration file memory 55 are performed in S18 and the routine then returns to S10. When the print key is depressed (i.e., S10 is YES, S11 and S12 are NO, and S13 ie YES), printing processes are performed in S19 on the text data in the text memory 51 or in a file selected from the files stored in the registration file memory 55. The routine then returns to S10.

Figure 8:
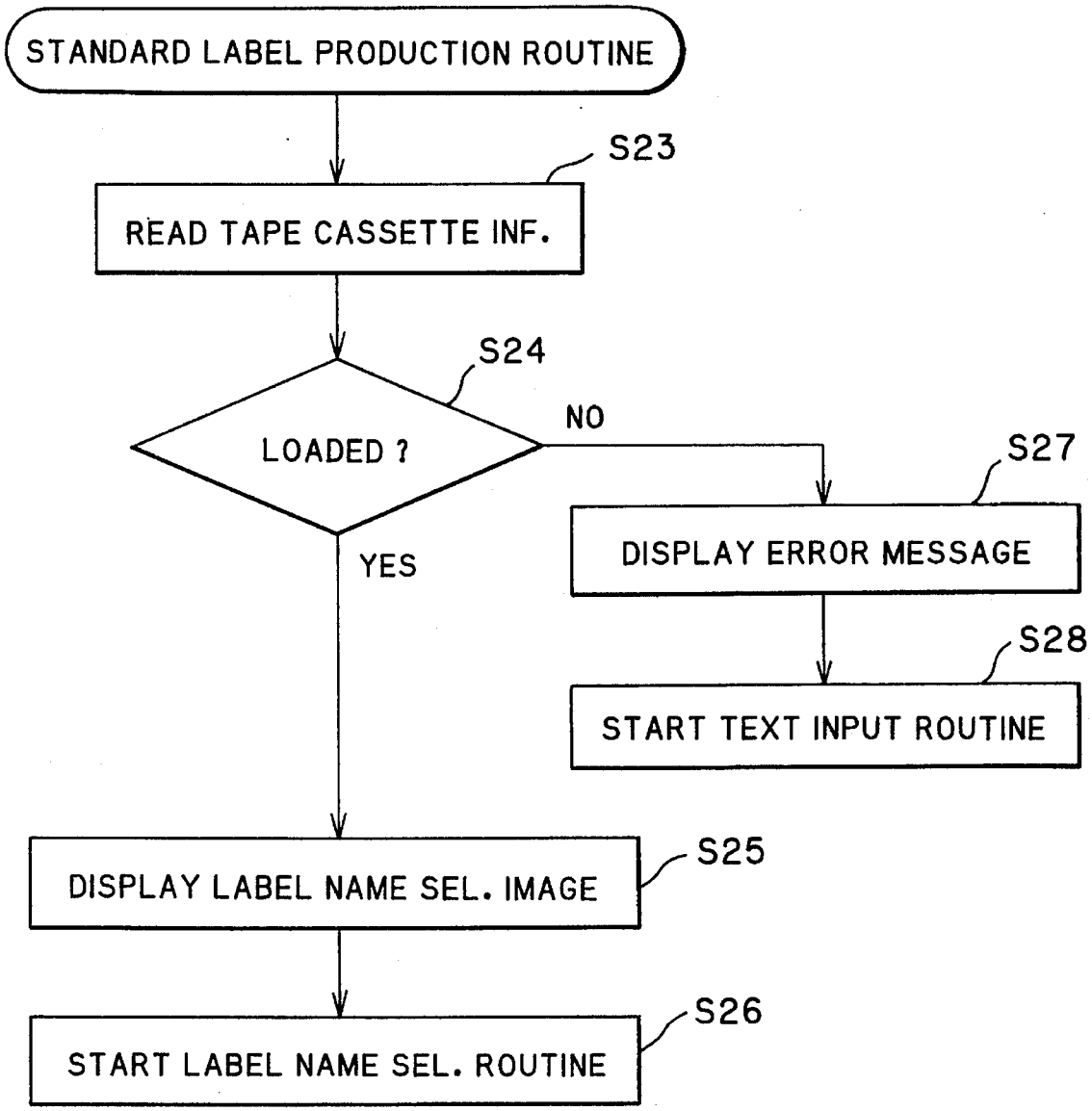
FIG. 8 shows a flowchart schematically representing a standard label producing routine of the tape printer.

When the standard label production key (SLP) is depressed to produce a desired label, such as for adhering to a video tape, an audio tape, or to the case of one of these (i.e., S10 is YES, S11 to S13 are NO, and S14 is YES), the standard label production routine represented by the flowchart in FIG. 8 ie started up in S20.

Figure 9:
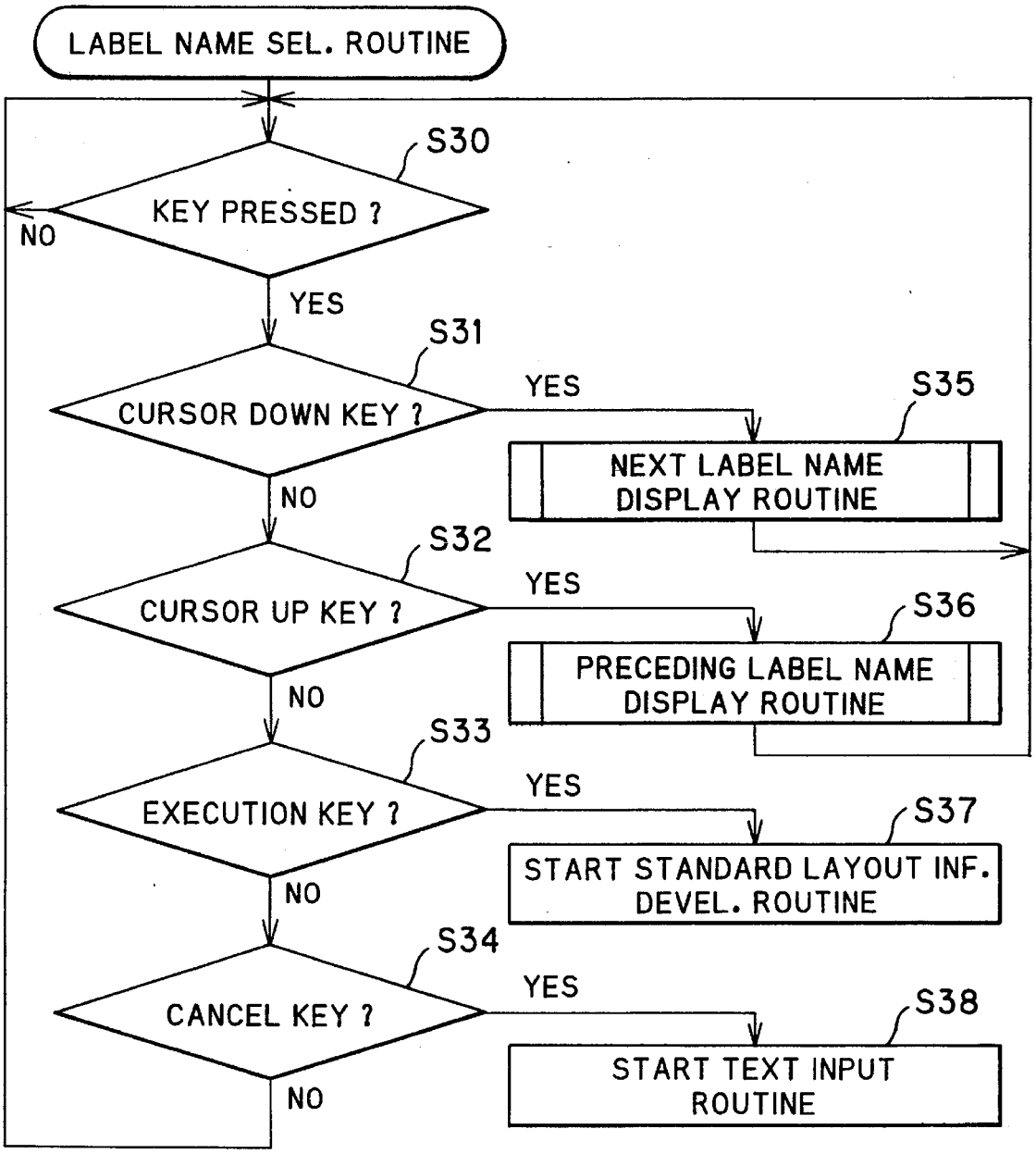
FIG. 9 shows a flowchart schematically representing a label name selection routine of the tape printer.
Figure 22:
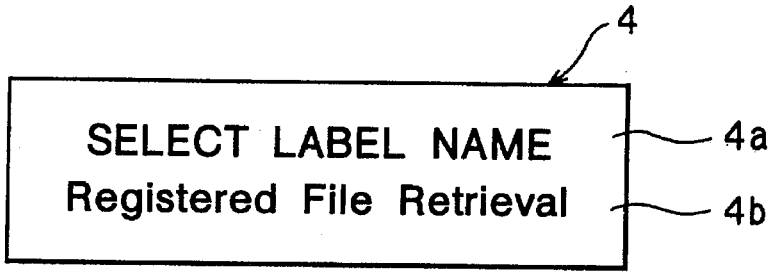
FIG. 22 shows an example of a label name selection image displayed on a display of the tape printer, the image being used by an operator to select a label name.

When the standard label production routine is started, tape cassette information is read from the cassette sensor 30 and stored in the tape information memory 54 in S23. When, based on the tape cassette information, a tape cassette 10 is determined to be loaded in the printing mechanism PM (i.e., S24 is YES), the pointer value LP will indicate in S25 the "Registered File Retrieval" label at the leading address of the label index table as shown in FIG. 4. Also in S25, a label name selection image will be displayed on the display 4 as shown in FIG. 22. In this example, the first label name "Registered File Retrieval," which is a label created and registered by a user, is indicated in the lower display region **4*b* of the display 4 based on the pointer value LP. Afterward, the label name selection routine represented by the flowchart in FIG. 9 is started up in S26**.

On the other hand, if no tape cassette 10 is loaded in the printing mechanism PM (i.e., S24 is NO), an error message reading "Tape Not Loaded" will be displayed in S27 on the display 4, but only for a predetermined time. Then, the text input routine is started up in S28.

Figure 10:
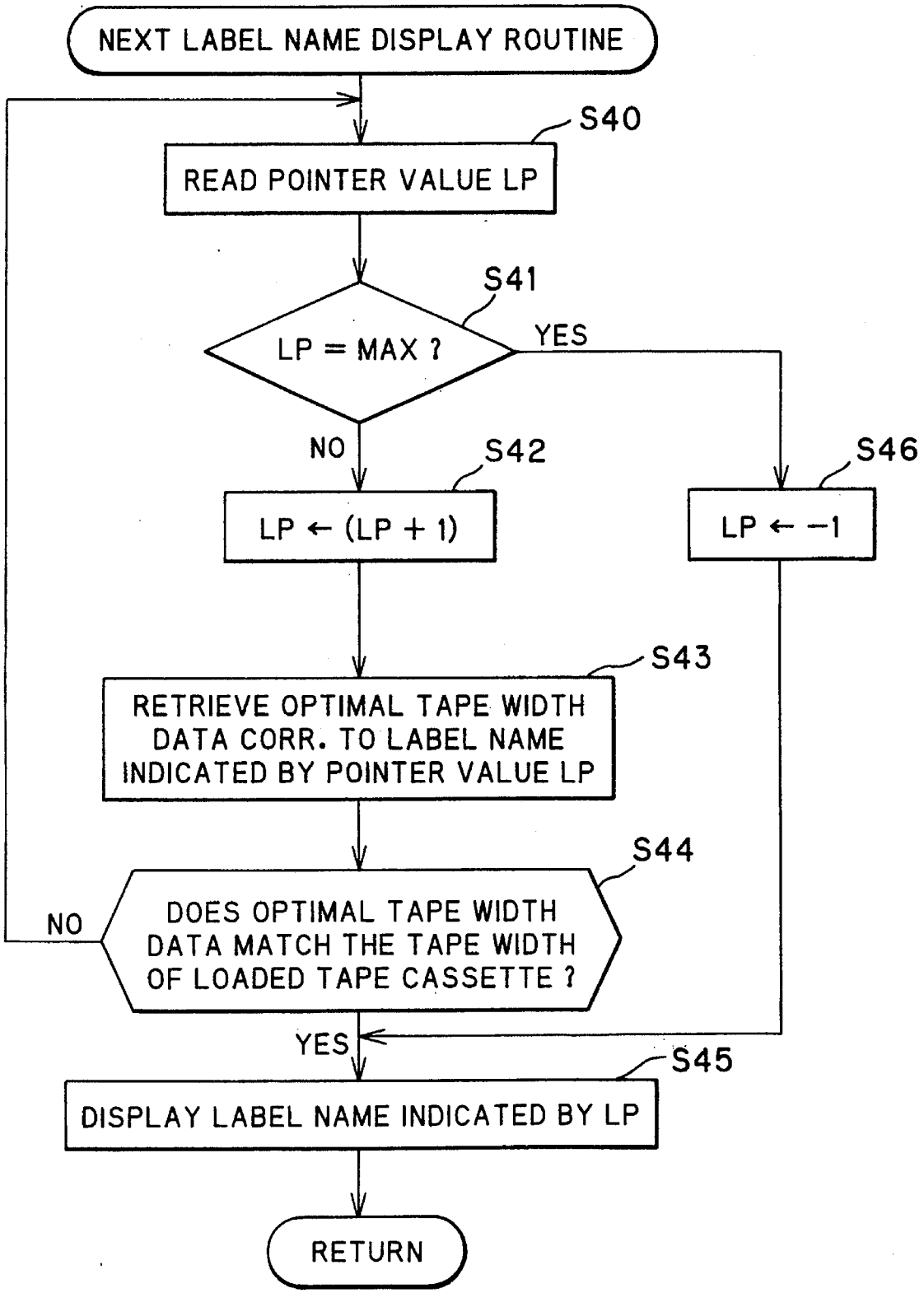
FIG. 10 shows a flowchart schematically representing a next label name display routine of the tape printer.

When the move cursor down key is depressed at the start of the label name selection routine (i.e., S30 and S31 are YES), the next label name display routine represented by the flowchart of FIG. 10 is executed in S35.

When the next label name display routine is started, the pointer value LP is read in S40. If the pointer value LP is not a maximum value MAX (i,e., S41 is NO), the pointer value LP is incremented by one in S42 and the optimal tape width data stored in the label characteristic information table corresponding to the label name indicated by the pointer value LP is retrieved in S43.

Figure 23:
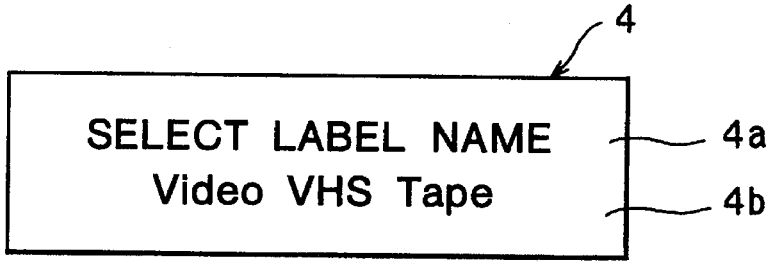
FIG. 23 shows an example of an image displayed on the display when a user selects a fixed label name using the image shown An FIG. 22.

When the optimal tape width data matches the tape width date stored in the tape information memory 54 for the mounted tape cassette 10 (i.e., S44 is YES), the label name indicated by the pointer value LP is retrieved from the label name table, developed in the RAM 31, and displayed on the display 4 in S45. Then, the program returns to S30 of the label name selection routine. For example, the next label "Video VHS Tape" is displayed as shown in FIG. 23. However, when the optimal tape width data does not match the tape width data stored in the tape information memory 54 for the tape cassette 10 mounted in the printing mechanism PM (i.e., S44 is NO), S40 and on are again executed.

On the other hand, if the retrieved pointer value LP is the maximum value MAX (i.e., S40 and S41 are YES), the pointer value LP is Set to "–1" in S46 and the program returns to S30 via S45. This results in the pointer value LP indicating the first label name "Registered File Retrieval" in the label index table as shown in FIG. 4, and in the first label name "Registered File Retrieval" being displayed on the display 4 as shown in FIG. 22.

Figure 11:
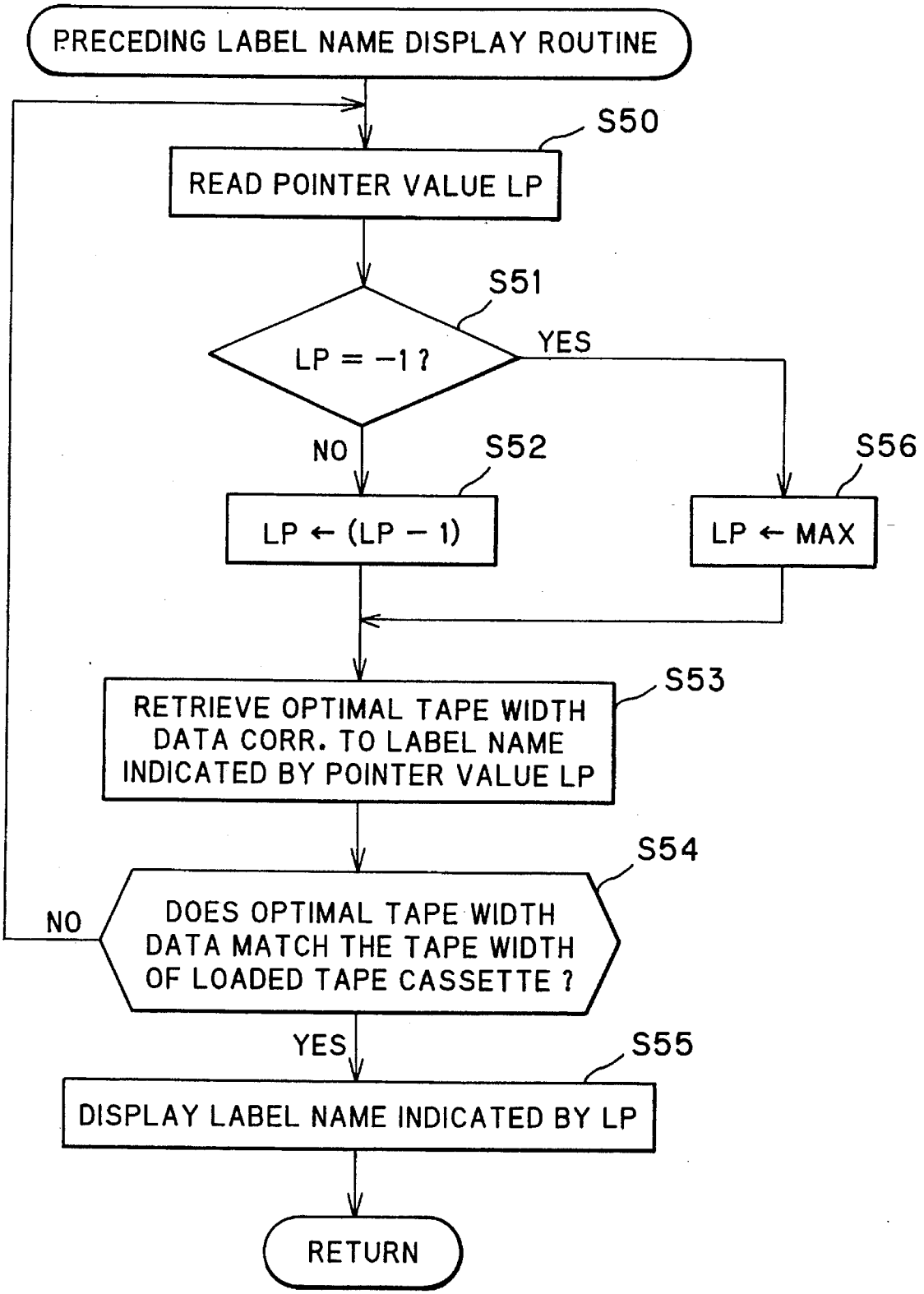
FIG. 11 shows a flowchart schematically representing a preceding label name display routine of the tape printer.

If during the label name selection routine the move cursor up key is depressed (i.e., 830 is YES, S31 is NO, and 832 is YES), the preceding label name display routine represented by the flowchart in FIG. 11 is executed in S36. When the preceding label name display routine is started, the laser beam L is retrieved in S50. When the pointer value LP is not "–1" (i.e., S51 is NO), the pointer value LP is decremented by one in S52 and the optimal tape width data corresponding to the updated pointer value LP is retrieved in S53. When the optimal tape width data matches the tape width of the loaded tape cassette 10 (i.e., S54 is YES), the label name indicated by the pointer value LP is displayed on the display 4 in S55, and the program returns to S30 of the label name selection routine. However, if the optimal tape width data differs from the tape width data on the tape cassette 10 (i.e., S54 is NO), S50 and on are executed. Also, when the retrieved pointer value LP is "–1" (i.e., S50 and S51 are YES), the maximum value MAX is set as the pointer value LP in S56, after which 853 and on are executed.

Figure 12:
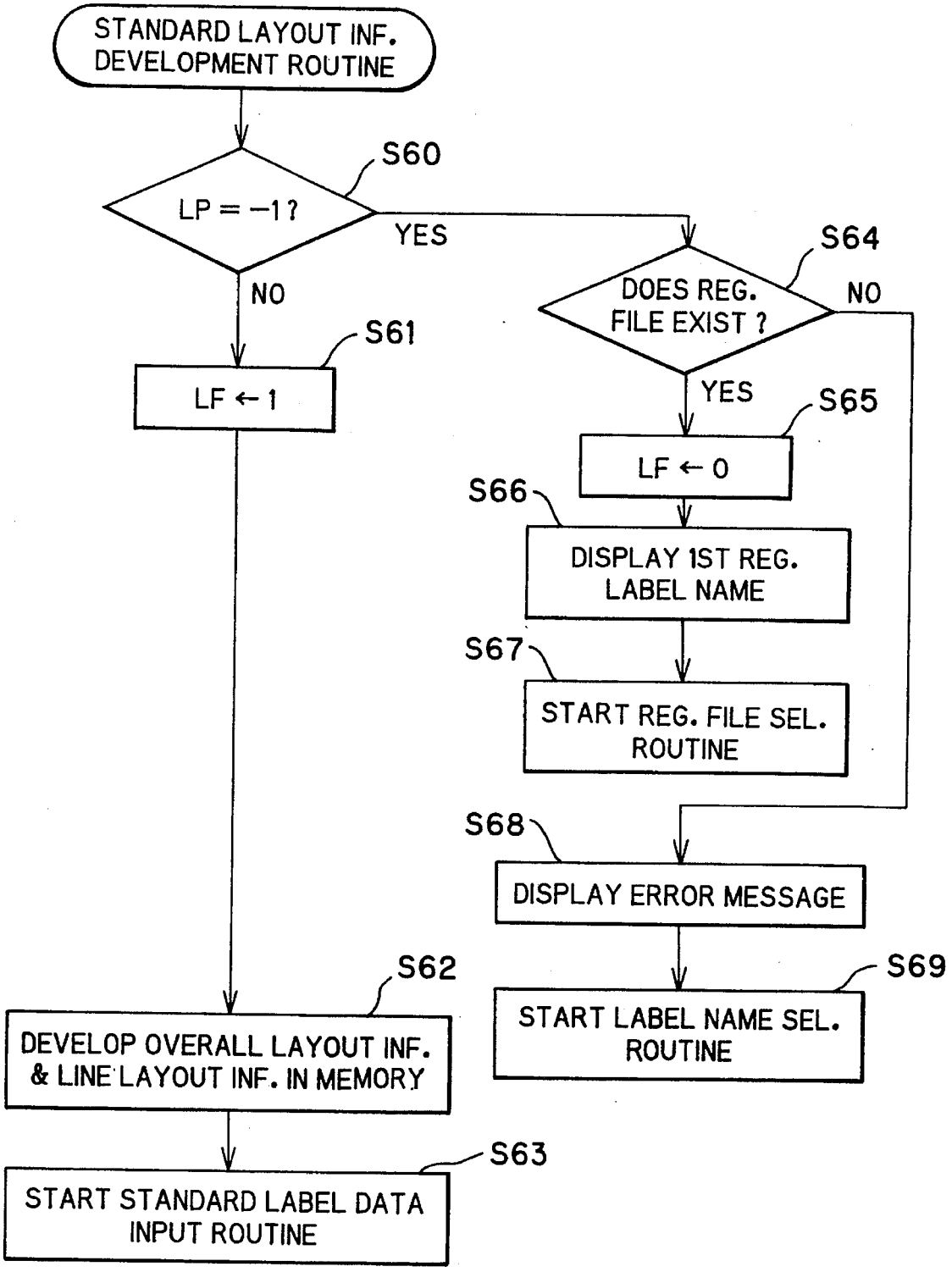
FIG. 12 shows a flowchart schematically representing a standard format information development routine of the tape printer.

On the other hand, when the delete key is depressed (i.e., S30 is YES, S31 to S33 are NO, and S34 is YES), the text input routine is started up in S38. If the execution key is depressed instead (i.e., S30 is YES, S31 to S32 are NO, and S33 is YES), the standard layout information development routine represented by the flowchart in FIG. 12 is executed in S37.

Figure 13:
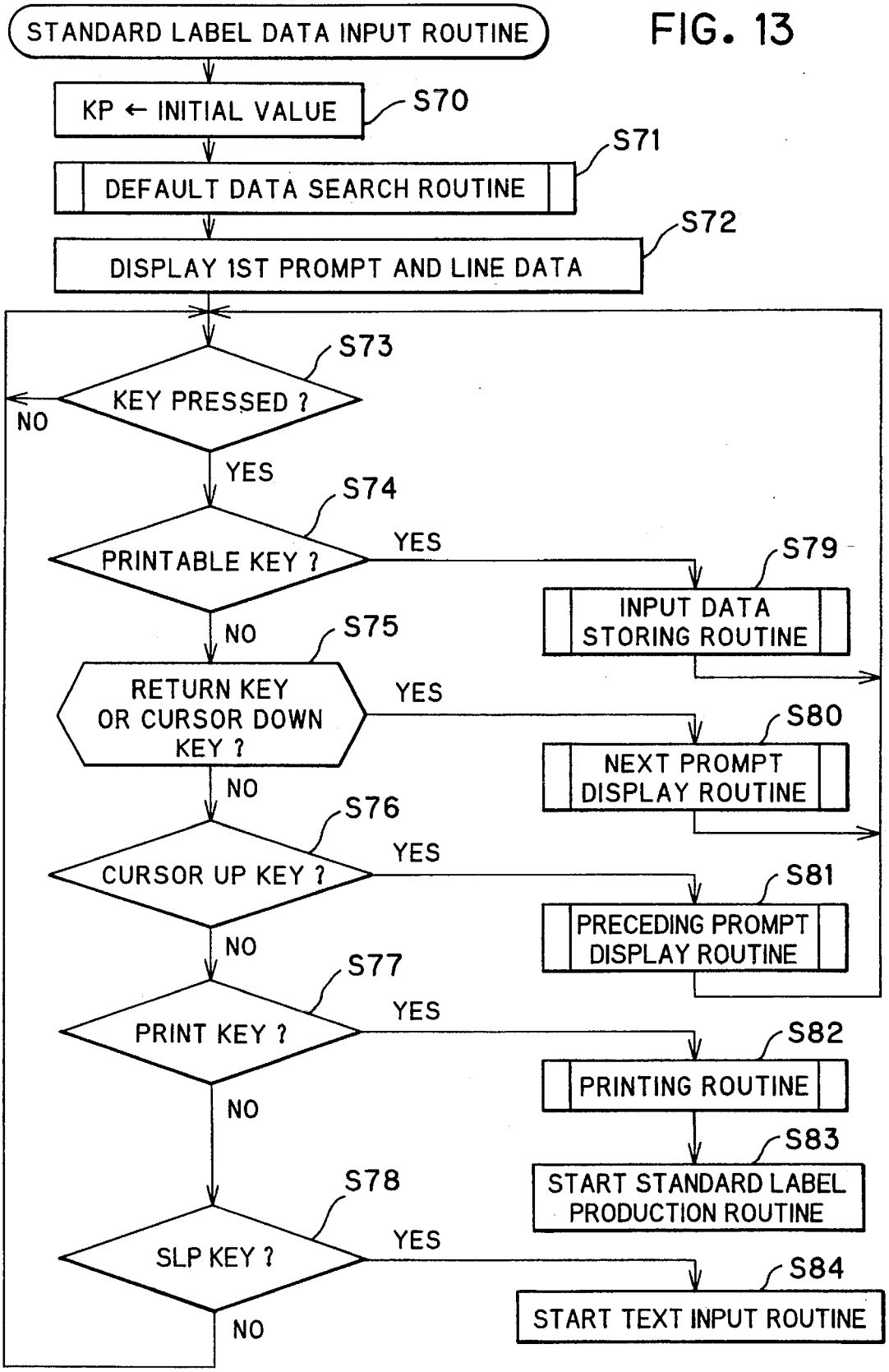
FIG. 13 shows a flowchart schematically representing a standard label data input routine of the tape printer.

When the pointer value LP is not "–1" at the start of the standard layout information development routine, that is when the pointer value LP indicates a fixed label stored in the ROM 43 and not a label name created and registered by a user (i.e., S60 is NO), a label name flag LF is set to one in S61, thereby indicating that the tape printer 1 is in a fixed label name selection mode. Then, in S62, the overall layout information stored in the label characteristic data of the selected fixed label name indicated by the pointer value LP is developed in the overall layout information memory 52. Also in S62, the line layout information of the selected fixed label name is developed in the text memory 51. Afterward, the standard label data input routine represented by the flowchart An FIG. 13 is started up and executed in S63. However, in a manner to be described later, if the pointer value LP is "–1" at the start of the standard layout information development routine, the text data registered as a registered file is controlled as standard layout information in S64 and on.

When the standard label data input routine is started, in S70 the prompt pointer value KP is set to indicates an initial value, that is, the leading address of the first prompt of label characteristic data of the selected fixed label file as shown in FIG. 5. Next, in S71 the default data search routine shown in FIG. 14 is executed for searching default data made from special characters and symbols such as "Min." and "Month, Date, Year."

Figure 14:
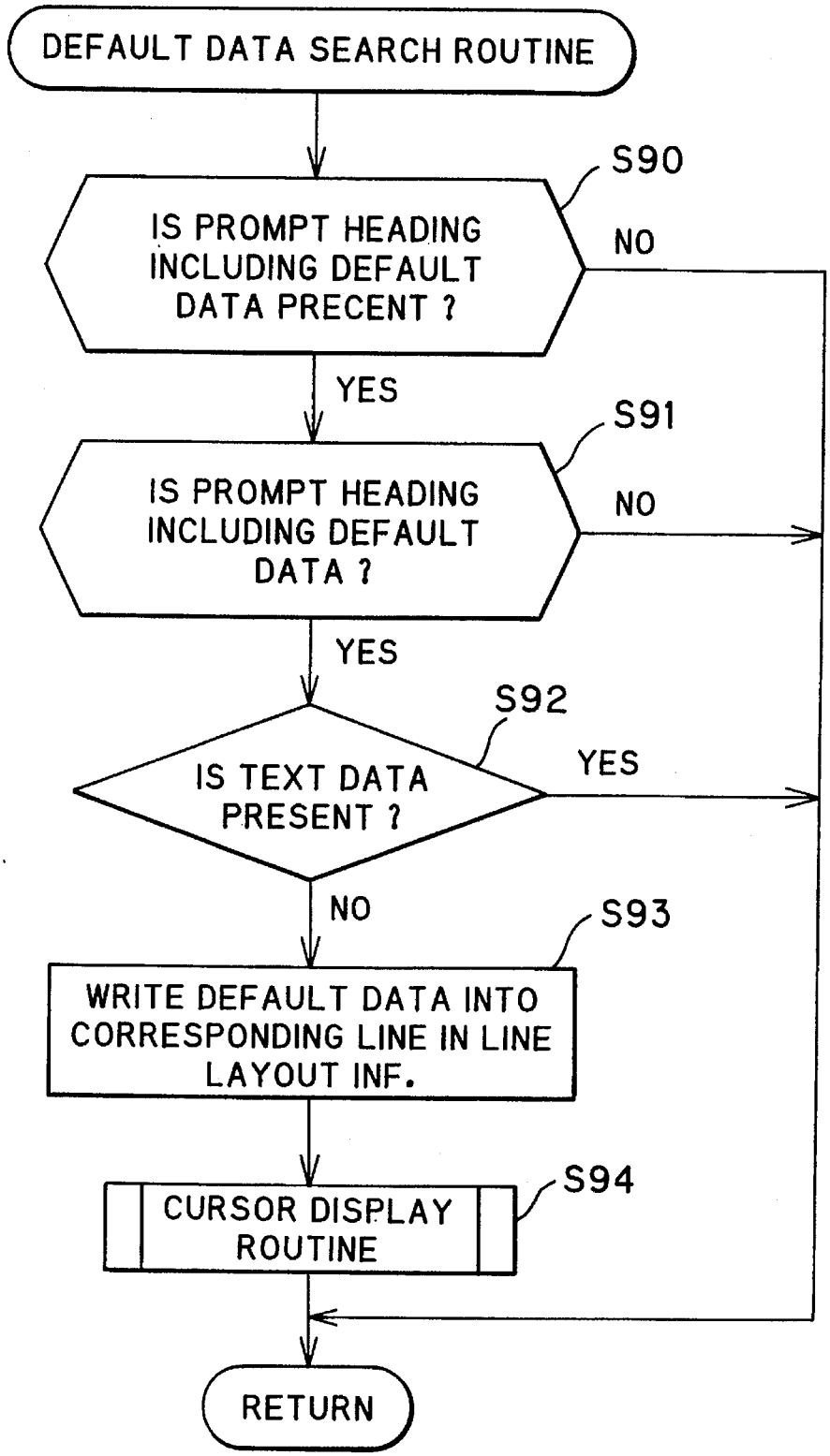
FIG. 14 shows a flowchart schematically representing a default data search routine of the tape printer.

When the routine shown in FIG. 14 is executed, S93 will be executed, but only if S90, S91, and S92 result in negative determinations. That is, in S93 the default data indicated by the leading default data address in the label characteristic data is inserted and written into the data storage position corresponding to the line layout information, but only if prompt heading that includes default data is present in the label characteristic data shown in FIG. 5, input (i.e., S90 is YES), if default data is present in the prompt heading indicated by the prompt pointer value KP (i.e., S91 is YES), and if, based on the line layout information data developed in the text memory 51, it is determined that no text data has been inputted into the prompt heading (i.e., S92 is NO). However, the program immediately returns to S72 of the standard label data input routine when one of S90 to S92 results in a negative determination, that is, if no prompt heading including default data is present (i.e., S90 is NO); if prompt heading including default data is present, but no default data is present in the input indicating heading indicated by the prompt heading pointer value KP (i.e., 890 is YES, 891 is NO); or if prompt heading including default data is present and default data is present in the input indicating heading indicated by the prompt heading pointer value KP, but text data has been inputted corresponding to the prompt heading (i.e., S90 to S92 are NO).

Figure 15:
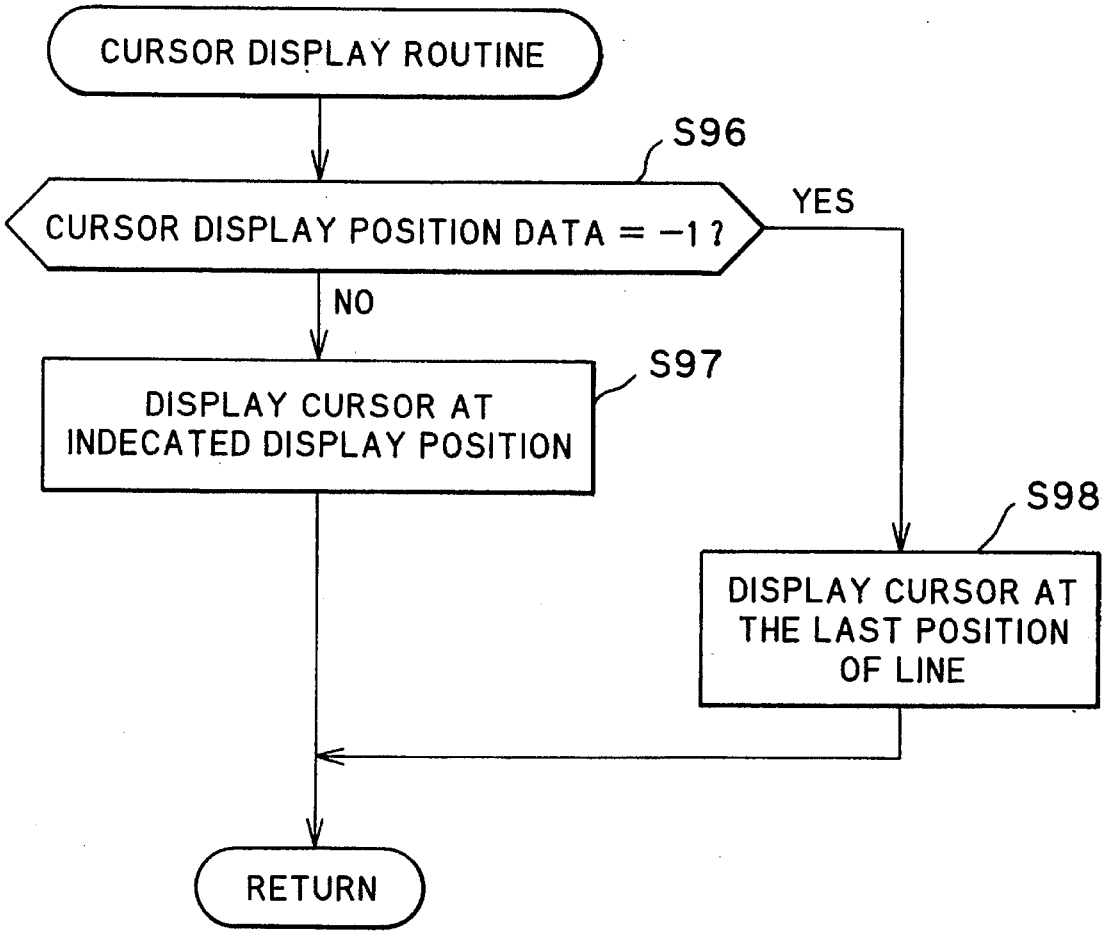
FIG. 15 shows a flowchart schematically representing a cursor display routine of the tape printer.

After execution of S93, the cursor display routine represented by the flowchart in FIG. 15 is executed in S94. If at the start of this routine the cursor display position data indicated in the label characteristic data is "0" or "D" which results in display of the given column position (i.e., S96 is NO), then An S97 the cursor K is displayed at the indicated display position at the lower display region **4*b* of the display 4 in accordance with the cursor display position data 2, whereupon the program returns to 872. However, when the cursor display position data is "–1" so the cursor K indicates the last position of the line (i.e., S96 is YES), then in S98 the cursor K is displayed at the end position of the line in the lower display region 4*b*, that is, at the return block mark or the return line mark of the line, whereupon the program returns to S72** of the standard label data input routine.

Figure 24:
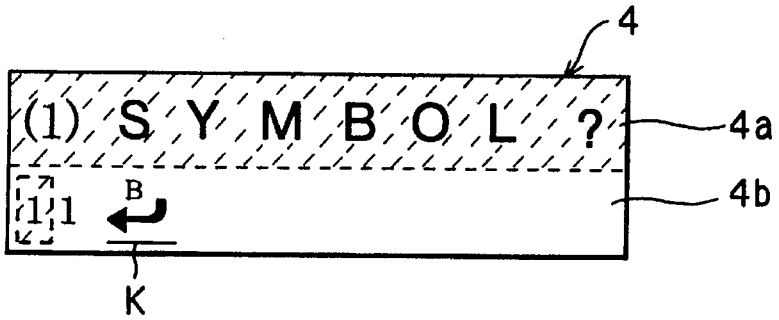
FIG. 24 Shows an example of a first prompt image displayed on the display.

In S72 of the standard label data input routine, the first prompt is displayed in the upper display region **4*a* and the text data input line, with a return line code or return block code, is displayed in the lower display region 4*b* of the display 4. Processes of S72 are performed based on the leading address of the first prompt indicated by the prompt leading pointer value KP set in S70; on the data in the prompt table; and on the line layout information data developed in the text memory 51 in S62 and S93. For example, when the execution key is depressed while the fixed label name "Video VHS Tape" is displayed as shown in FIG. 23, then, as shown in FIG. 24, the first prompt "Symbol?" at the leading address is displayed in black on a white background in the upper display region 4*a* of the display 4. In the lower display region 4*b***, the number of blocks "1" and the number of lines "1" are displayed at the first column position of the display and the return block mark is displayed with the cursor K in the second column position of the display.

Figure 25:
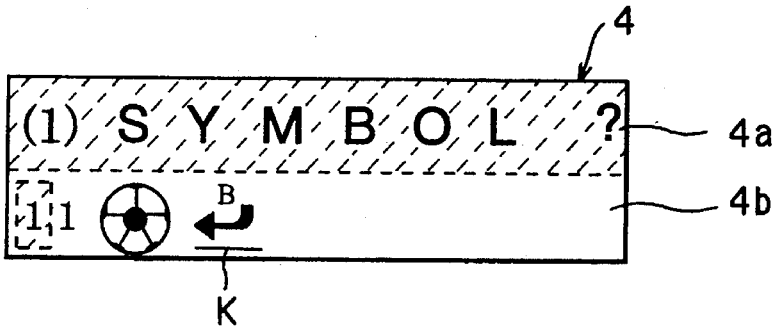
FIG. 25 shows an example of an image displayed on the display when a user makes a selection whale the first prompt image is displayed as shown in FIG. 24.

When a printable key is depressed (i.e., S73 and S74 are YES), then in S79 the code data corresponding to the depressed key, or the code data of the changed mark or symbol, is insertedly stored in the text memory 51 at a predetermined storage position corresponding to the prompt presently displayed. Also, the character or symbols corresponding to the code data is then displayed in front of the cursor K. Then the program returns to S73. For example, the symbol for a soccer ball as shown in FIG. 25 is inserted and displayed at the input position in front of the cursor K.

Figure 16:
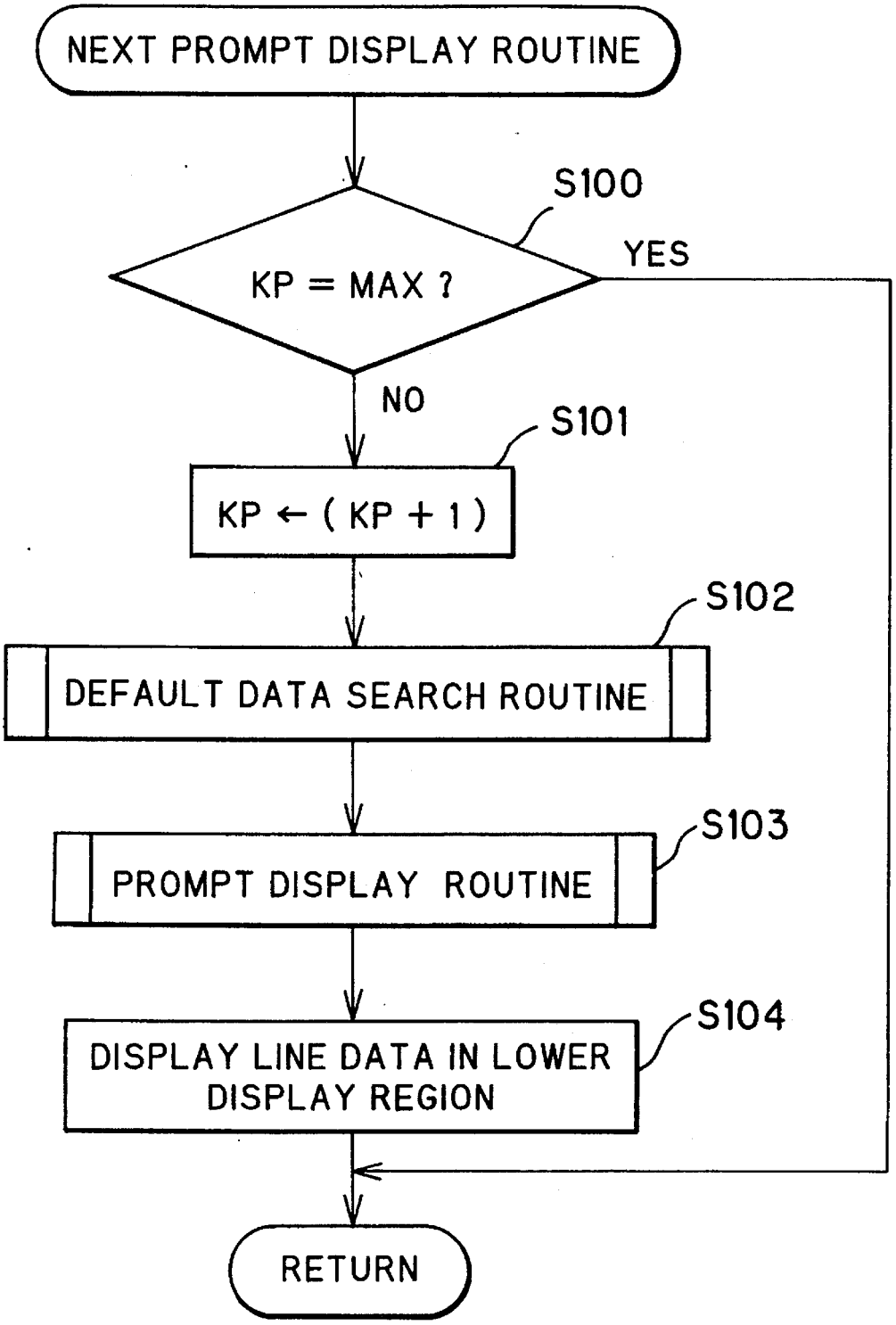
FIG. 16 shows a flowchart schematically representing a next prompt display routine of the tape printer.
Figure 17:
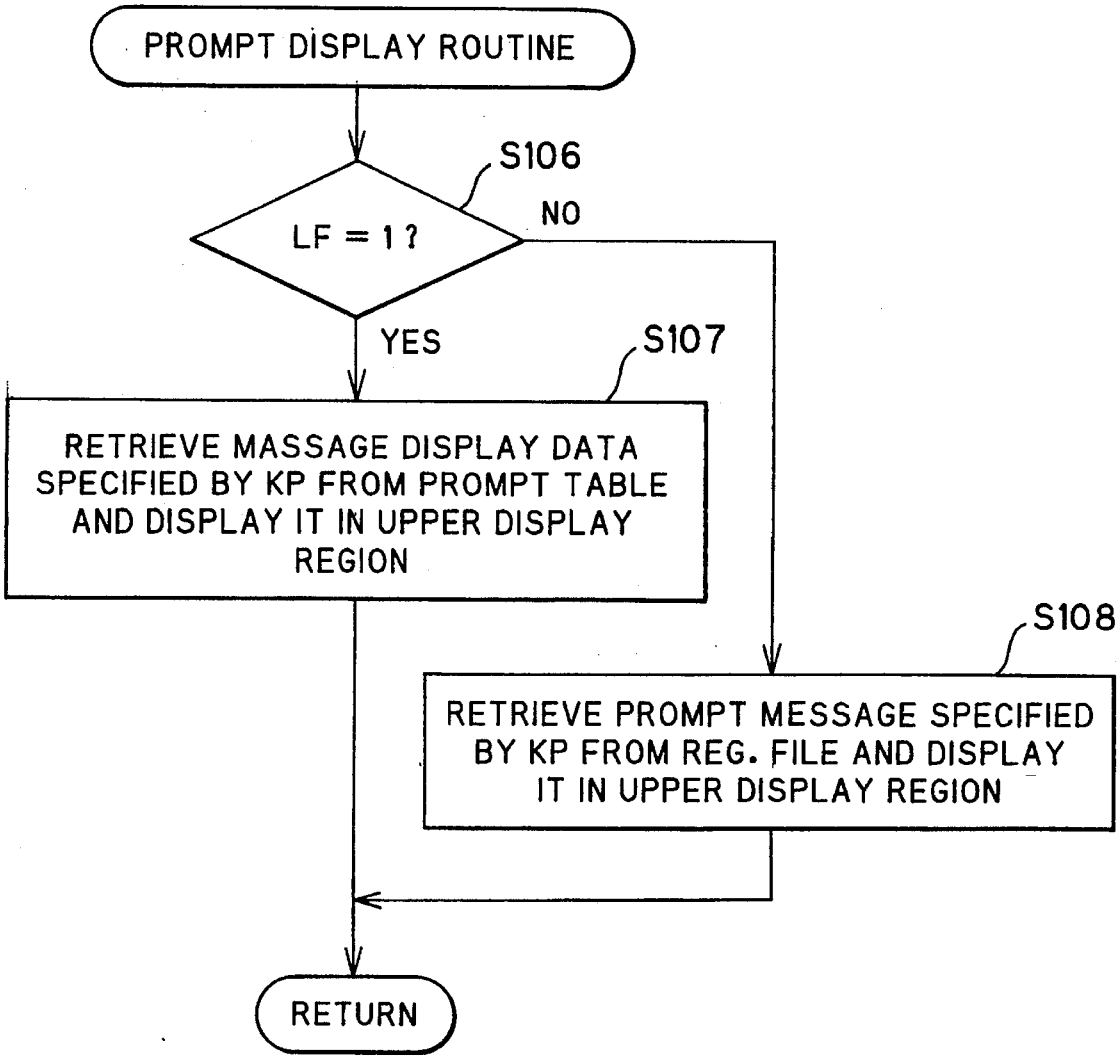
FIG. 17 shows a flowchart schematically representing a prompt display routine of the tape printer.

When the line return key or the move cursor down key is depressed (i.e., S73 is YES, S74 is NO, and S75 is YES), the prompt display routine shown in FIG. 16 is executed in S80. When the prompt heading pointer value KP is not the maximum value MAX at the start of the prompt display routine (i.e., S100 is NO), the prompt heading pointer value KP is incremented by one in S101 and the default data search routine described previously is executed in S102. Next, the prompt display routine represented by the flowchart in FIG. 17 is executed in S103.

When the label name flag LF is one at the start of the prompt display routine, thereby indicating that the tape printer 1 is in the fixed label name selection mode, (i.e., S106 is YES), the message display data stored in the prompt table at the position specified by the prompt heading pointer value KP is retrieved and displayed in the upper display region **4*a* of the display 4 in S107. Then, the program returns to S104** of the prompt display routine.

In S104 of the prompt display routine, the text data input line corresponding to the prompt heading pointer value KP is retrieved based on the line layout information data developed in the text memory 51 and displayed in the lower display region **4*b* of the display 4. Then, the program returns to S73 of the standard label data input routine. However, if the prompt heading pointer value KP matches the maximum value MAX at the start of the next prompt display routine (i.e., S100 is YES), the program returns immediately to S73**.

Figure 26:
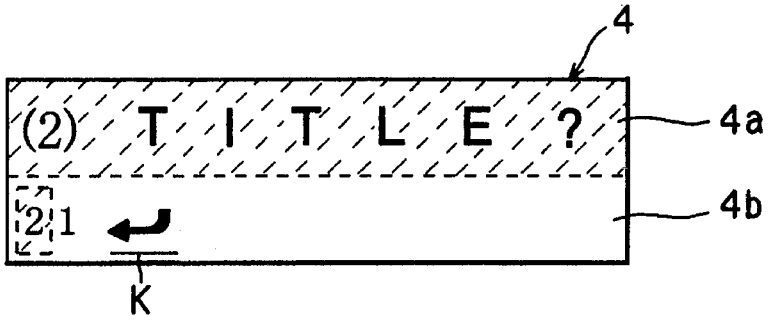
FIG. 26 shows an example of a second prompt image displayed on the display.
Figure 27:
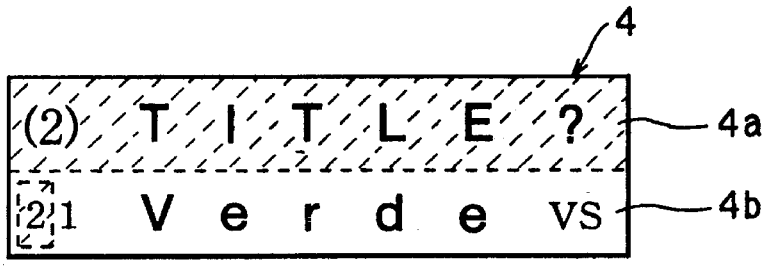
FIG. 27 shows an example of an image displayed on the display when e user makes a selection while the second prompt image is displayed as shown in FIG. 26.

As shown in the example of FIG. 26, the second prompt "Title?" is displayed in black on a white field in the upper display region **4*a* of the display 4. Also, the block number "2" and the line number "2" are displayed in black on a white field in the first digit display position, and the return line mark is displayed with the cursor K in the second digit display position, of the lower display region 4*b* of the display 4. As shown in the example of FIG. 27, when the return line key is depressed after input of desired text by operating printable keys, the inputted text data "Verde vs Marinos" is stored in the position corresponding to the text memory 51** and is displayed by inserting six character from the start of the line.

Figure 28:
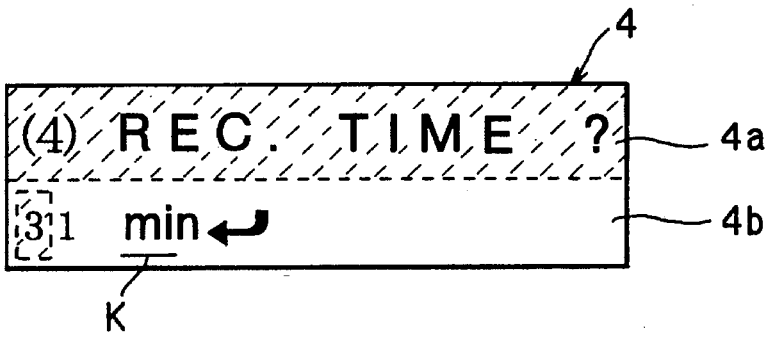
FIG. 28 shows an example of a third prompt image, including the default data "Min.," displayed on the display.
Figure 29:
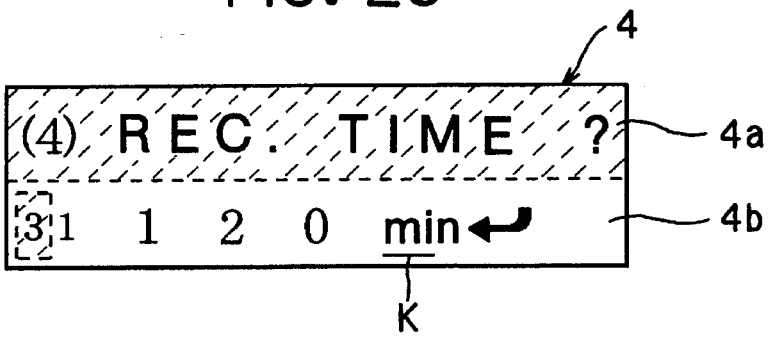
FIG. 29 shows an example of an image displayed on the display when a user inputs text data while the third prompt image is displayed as shown in FIG. 28.

Further, operating the move cursor down key twice displays the fourth prompt "Recording Time" in the upper display region **4*a* as shown in the example of FIG. 28. At this time, the text data inputline including default data "Min." and the return line mark corresponding to the prompt heading is displayed in the lower display region 4*b* as the first line of the third block. However, because the cursor display data is "0" at this time, the cursor K is displayed at the position of the default data for "Min." As shown in the example of FIG. 29, the text data "120" inputted by operation of numeric keys is stored at the corresponding storage position in the text memory 51** and displayed inserted directly before the cursor K. A detailed explanation of operations for displaying, in the text data input line, the default data associated with the prompt will be provided.

The RAM 43 has prestored therein display information, print layout information, and default data. The display information is for displaying a plurality of prompts, such as "Symbol?" and "Title?," and a plurality of labels, such as "Video VHS Tape" and "Video 8 mm & Hi 8 Case," in a predetermined layout. The print layout information ie made from line layout information and overall layout information for printing, in a predetermined layout, text data inputted in association with the prompts. The default data includes specific characters, symbols, and codes, such as "Min.," preset to be Printed in association with a portion of the text data inputted in association with the plurality of prompts. The plurality of label names are displayed one after the other on the display. When one of the label names is selected, the plurality of prompts associated with the selected label name and the text data input line association with each prompt are displayed one after the other on the display. When default data is stored in association with an prompt, the default data is also displayed with the prompt.

For example, when default data "Min." is stored in association with the text data input line and the prompt "Recording Time?," then the default data is displayed with the text data input line. Additionally, when default data is displayed in the lower display region 4b, that is, in the text data input line that is in association with the prompt, the cursor K is displayed at the lead position of the text data input line determined from its association with the default data. Therefore, text data can be inputted directly before the default data without having to move the cursor K to that position. This facilitates input of text data.

The device can be designed so that default data of frequently inputted special marks and character strings can be stored in association with headings (such as "Item:," "Lot #:," "Section:," or "P.O. Box #") of fixed label names (such as "Equipment Control" and "Name and Address"). Also, default data can be established in registration layout information which a user registered as a registered label name (registered file name). When this registered label name is selected, any default data included in text data input line data that is associated with any of the prompts for the registered label name will be displayed in the text data input line.

Figure 18:
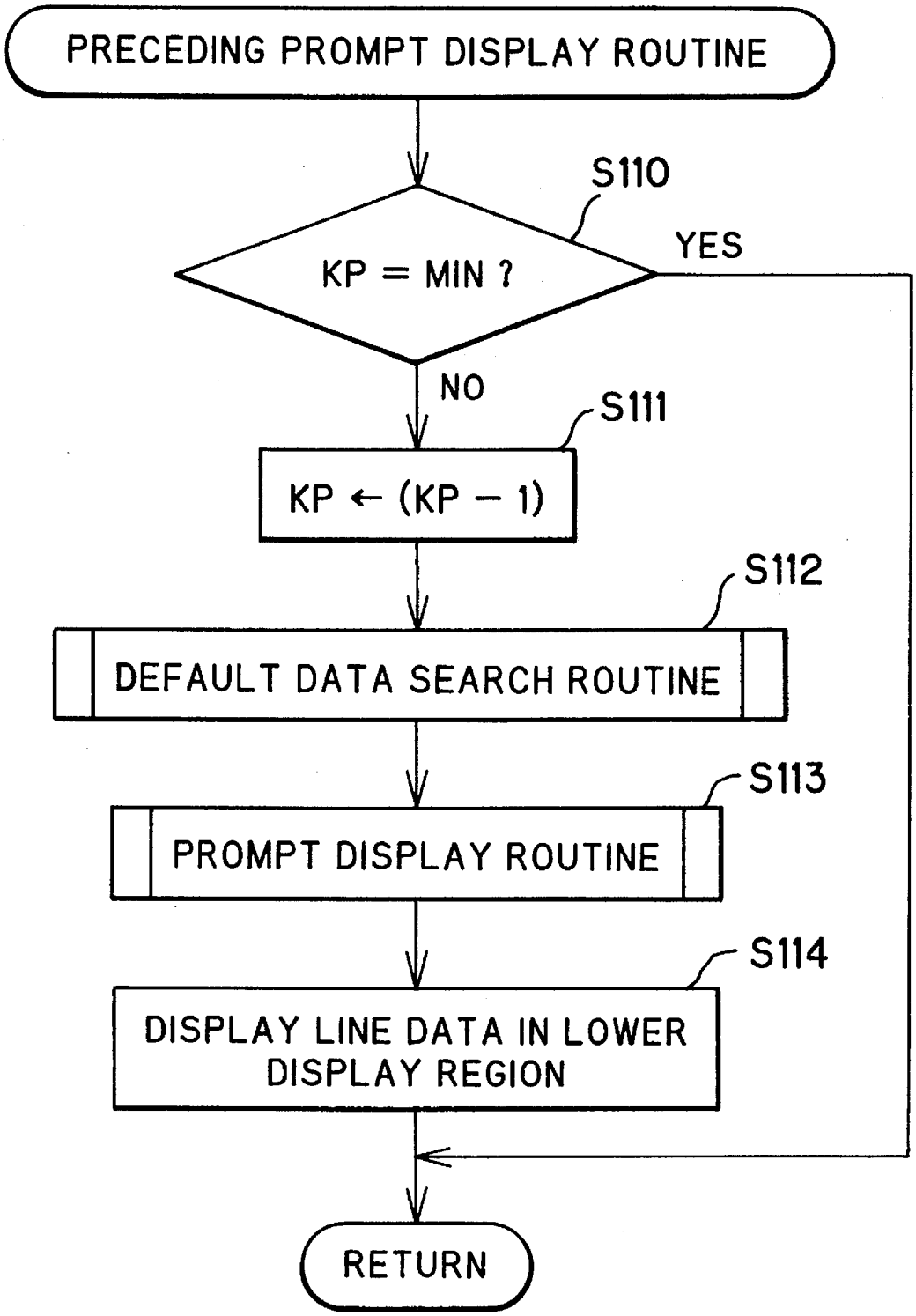
FIG. 18 shows a flowchart schematically representing a preceding prompt display routine of the tape printer.

On the other hand, when the move cursor up key is depressed (i.e., S73 is YES, S74 and S75 are NO, and S76 is YES), then the preceding prompt display routine shown in FIG. 18 is executed in S81. When the prompt heading pointer value KP does not match the maximum value MAX at the start of this routine (i.e., S110 is NO), the prompt heading pointer value KP is decremented by one in S111. Then, the default data search routine is executed in S112 and the prompt display routine is executed in S113. Afterward, based on the line layout information data developed in the text memory 51, the text data input line indicated by the prompt heading pointer value KP is retrieved and displayed in the lower display region 4b of the display 4 in S114, whereupon the program returns to S73.

Figure 30:
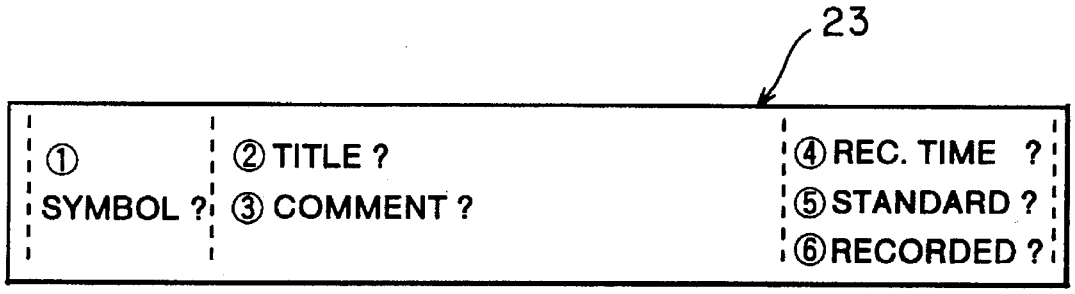
FIG. 30 shows prompts at print positions of text data inputted as prompted by respective prompts.
Figure 31:
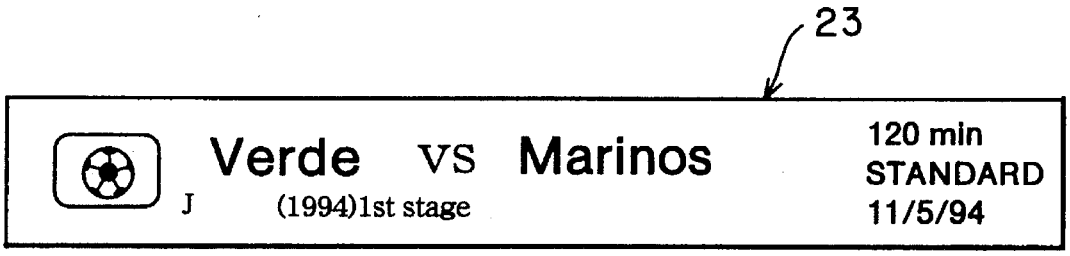
FIG. 31 shows an example of a tape-shaped label produced by the tape printer according to the label name "Video VHS Tape"

When the print key is depressed after text data is inputted as prompted by the plurality of prompts displayed for the selected fixed label name (i.e., S73 is YES, S74 to S76 are NO, S77 is YES), then printing process are performed in S82 based on the overall layout information stored in the overall layout information memory 52 and based on the line layout information stored with text data in the text memory 51. Then, the standard label production routine is started and executed in S83. Because as shown in FIG. 30 the printing positions for text data inputted as prompted by the above-described six prompts are individually set for the fixed label name "Video VHS Tape," the text data is printed at appropriate print positions. In this way, the tape-shaped label 23 shown in FIG. 31, that can be adhered to the back of a VHS type video tape, can be simply produced using the tape printer 1.

Figure 19:
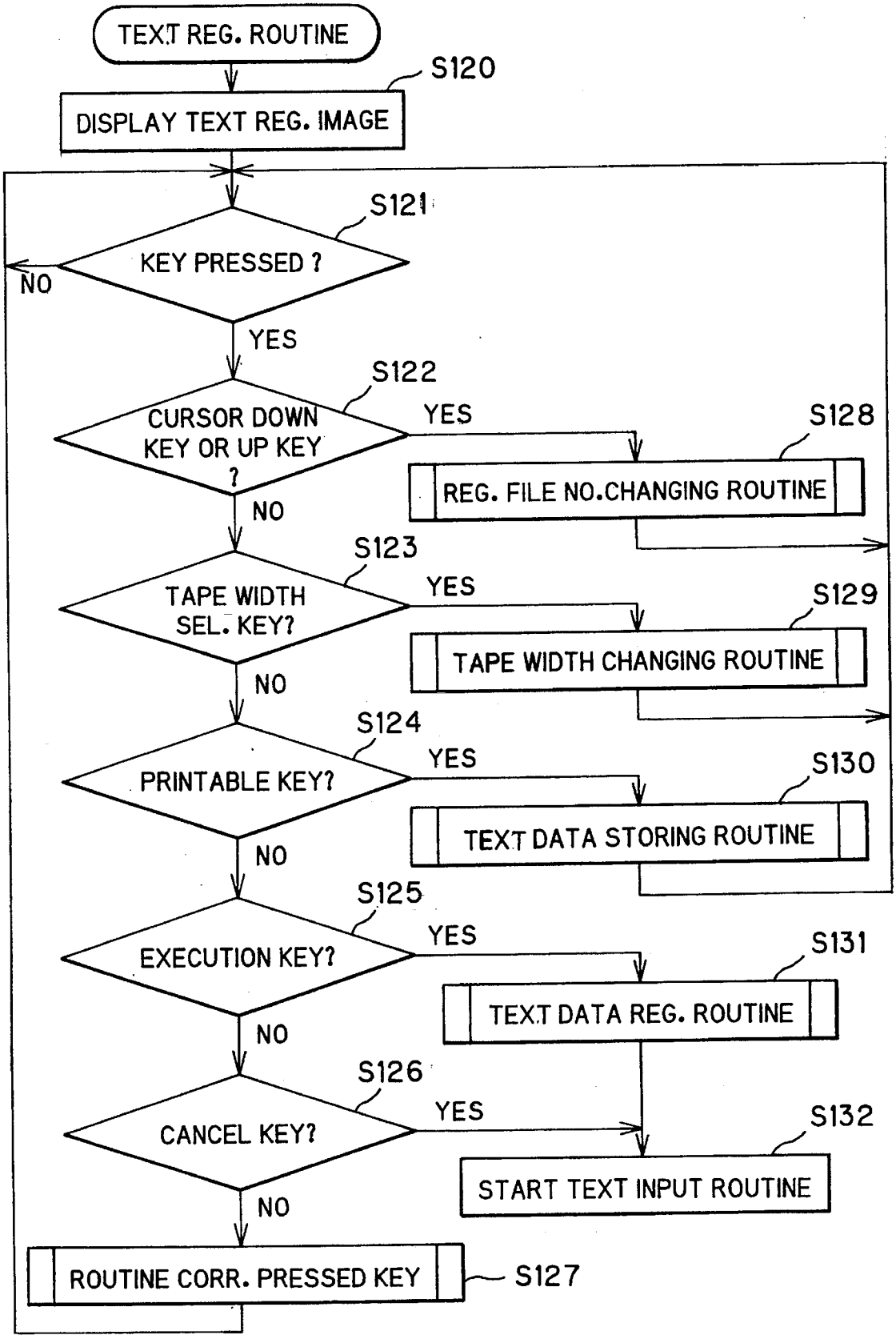
FIG. 19 shows a flowchart schematically representing a text registration routine of the tape printer.
Figure 32:
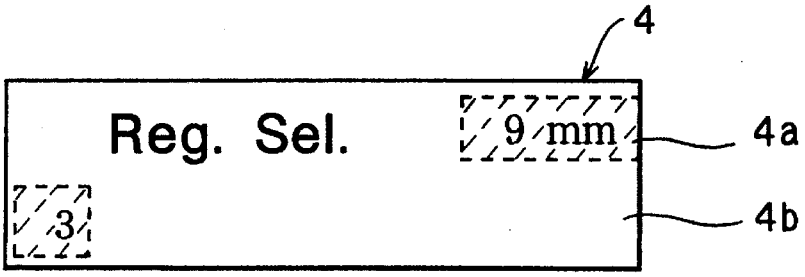
FIG. 32 shows an example of an image displayed at the start of the text registration routine of FIG. 19.

When the text registration key is depressed during the text input routine (i.e,, S10 is YES. S11 through S14 are NO, and S15 is YES), the text registration routine represented by the flowchart in FIG. 19 is started up and executed in S21. At the start of the program, the text registration image is displayed in S120. As shown in the example of FIG. 32, the character string "Reg. Sel." (Registration Selection), which is for registering files and for selecting a registration number, and the default tape width "9 mm" are displayed in the upper display region 4a of the display 4. Also, the smallest of the as yet unregistered registration numbers is displayed in black on a white field in the lower display region 4b of the display 4.

When the move cursor down key or the move cursor up key is depressed (i.e., S121 and S122 are YES), the registration number is changed and displayed in S128 in correspondence with the depressed cursor movement key. Then the routine returns to S121. When-the change tape width key is depressed (i.e., S121 is YES, S122 is NO, and S123 is YES), the displayed tape width is changed. Repeatedly operating the change tape width key will cause the displayed tape width to cyclically change. For example, if the tape width of "9 mm" is displayed first, subsequent operations of the change tape width key will cause "12 mm" to be displayed, then "18 mm," "24 mm," and "6 mm," whereupon a further operation restarts the cycle with display of "9 mm."

Figure 33:
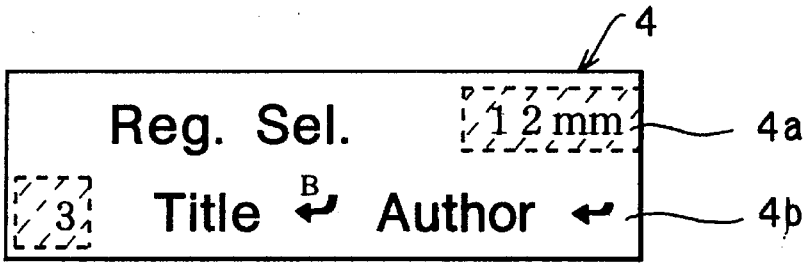
FIG. 33 shows an example of an image displayed on the display when a user inputs text data while the image shown in FIG. 28 is displayed.

When a printable key is depressed (i.e., S121 is YES, S122 and S123 are NO, S124 is YES), the code data corresponding to the depressed key is stored in the text memory 51 as text data in S130. In the example shown in FIG. 33, the displayed tape width was switched to "12 mm" by operating the tape width change key once. Also, inputted text data "Title, Return Block Mark, Author, Return Line Mark," and so on is displayed in the lower display region 4b. Then the program returns to S121.

When the layout change key is depressed (i.e., S121 is YES and S122 to 8126 are NO), processes corresponding to the depressed key are performed in S127. Examples of processes performed in S127 are setting of the type of line print provided, the inter-character pitch, whether characters are to be horizontally or vertically printed, and other overall layout information related to overall layout at which the label is to be printed. Also, size and font of printed characters and other line layout information related to how each line is printed is set in S127. Afterward, the program returns to S121.

When the delete key is depressed (i.e., 8121 is YES, S122 to S125 are NO, and S126 is YES), then the text input routine is started up in S132, When the execution key is depressed (i.e., S121 is YES, 8122 to 8124 are NO, and S125 is YES), then registration processes are executed in S131. During these registration processes, the text data which is stored in the text memory 51 and which includes tape width data and line layout data is registered with the registered file name in the text data area of the registration file memory 55. Also, the overall layout information for the registered file is registered in the overall layout information area of the registration file memory 55 in conjunction with the text data. After processes of S131 are completed, the text input routine is started up in S132.

It should be noted that the print layout information is made up of print line layout information and overall layout information. The registration layout information and display information are stored in the registration file memory 55 in the same way as the fixed layout information stored in ROM 43. The display information includes label names and prompts composed of text data. The registration layout information includes print layout information.

It should be noted that users can produce labels from registered file data in the same way as described previously for producing labels from fixed label data. While the display 4 is as shown in FIG. 22 during execution of the label name selection routine shown in FIG. 9, operating the execution key will start up the standard layout information development routine shown in FIG. 12. Because the display 4 indicates selection of the "Registered File Retrieval" label, the pointer-value LP will indicate "–1," resulting in a positive determination in S60. When a registered file exists in the registration file memory 55 (i.e., S64 is YES), the label name flag LF is reset to zero in S65.

Figure 20:
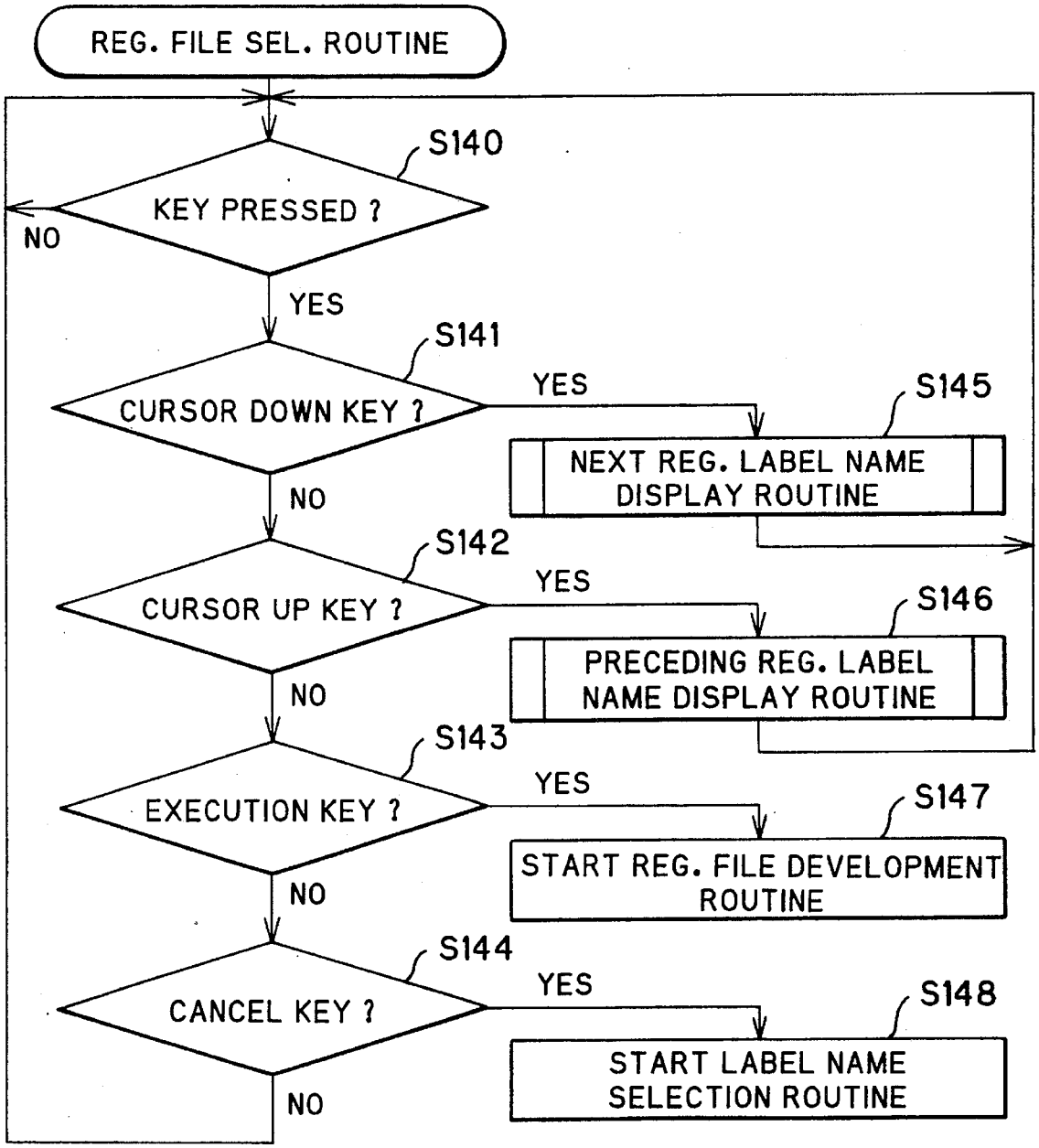
FIG. 20 shows a flowchart schematically representing a registered file routine of the tape printer.
Figure 34:
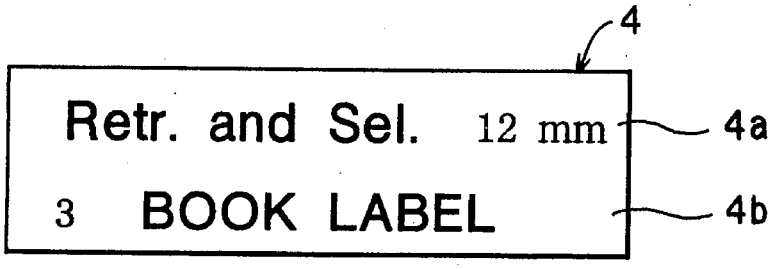
FIG. 34 shows an example of an image displayed on the display during the standard format information development routine of FIG. 12.

Next, the first registered file of the registered label names, referred to as registered label names hereinafter, stored in the registration file memory 55 is displayed at the lower display region 4b of the display 4 in S66. Then, the registered file selection routine represented by the flowchart in FIG. 20 is started up and executed in S67. In the example shown in FIG. 34, a "Retr. and Sel." (Retrieve and Select) message, which prompts selection of a registered label name, and the set tape width of "12 mm" are displayed in the upper display region 4a. Also, the first registered file name "Book Label" is displayed in the lower display region 4b with the file number "3."

Figure 21:
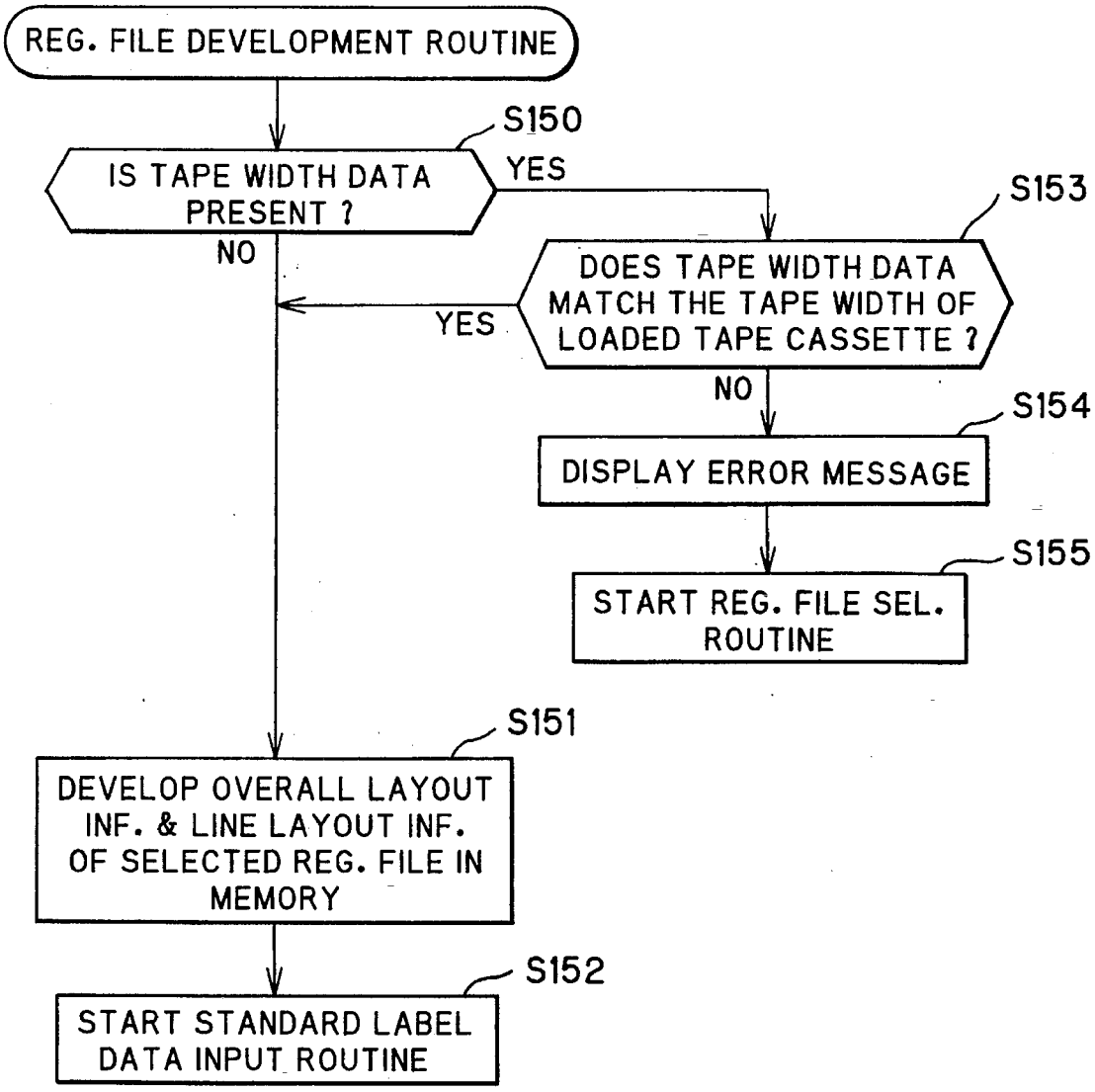
FIG. 21 shows a flowchart schematically representing a registration file development routine of the tape printer.

When the move cursor down key is depressed at the start of the registered file selection routine (i.e., S140 and 141 are YES), processes are executed in S145 for displaying the next registered label name in the lower display region 4b. Then the program returns to S140. When the move cursor up key is depressed (i.e., S140 is YES, S141 is NO, and S142 is YES), processes for displaying the preceding registered label name at the lower display region 4b is executed in S146. Afterward, the program returns to S140. On the other hand, if the delete key is depressed (i.e., S140 is YES, S141 to S143 are NO, and S144 is YES), the label name selection routine is started up in S148. If the execution key is depressed (i.e., S140 is YES, S141 to S142 are NO, and S143 is YES), the registered file development routine represented by the flowchart of FIG. 21 is started up and executed in S147.

When no tape width data is found in a search of the registration file memory 55 at the start of the registered file development routine (i.e., S150 is NO), text data that is registered in the text data area of the registration file memory 55 with the selected registered label name and that includes tape width data and lane layout data is developed in the text memory 51 in S151. Additionally, the overall layout information in conjunction with this text data in the overall layout information area of the registration file memory 55 is developed in the overall layout information memory 52. Afterward, the standard label data input routine represented by the flowchart of FIG. 13 is started up and executed in S152.

Figure 35:
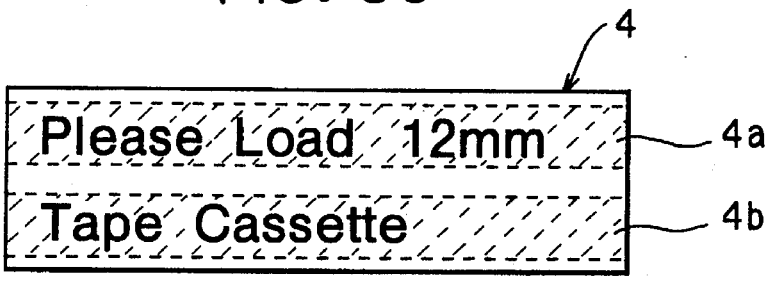
FIG. 35 shows an example of an error message, displayed on the display during the registration file development routine of FIG. 21, to prompt the user to mount a tape cassette with an optimal tape width.

When, at the standard label data input routine, tape width data is present (i.e., S150 is YES) and the optimal tape width matches the tape width data stored in the tape information memory 54 about the mounted tape cassette 10 (i.e., S153 is YES), then S151 is executed and afterward the standard label data input routine is started up in S152. However, when the optimal tape width does not match the tape width data stored (i.e., S153 is NO), then an error message prompting the user to mount a tape cassette 10 with the optimal tape width ie displayed on the display 4 in S154. Afterward, the registered file selection routine is started in S155. In the example shown in FIG. 35, the optimal tape width is "12 mm" so an error message reading "Please Load 12 mm Tape Cassette" is displayed on the display 4.

During the standard label data input routine, the prompt heading pointer KP serially indicates, as prompts, each series of text data developed and separated by return line codes and return block codes in the text memory 51. Because no default data exists, default data search processes will result in a negative determination in S90. Further, regardless of whether the prompt display routine represented by the flowchart of FIG. 17 is executed in S103 of the next prompt display routine (S80) or in S113 of the preceding prompt display routine (S81), when the label name flag LF is reset to zero while the prompt display routine is being executed (i.e., S106 is NO), then in S108 the text data of the registered file indicated by the prompt heading pointer value KP is retrieved and displayed in the upper display region 4a as a prompt.

Figure 36:
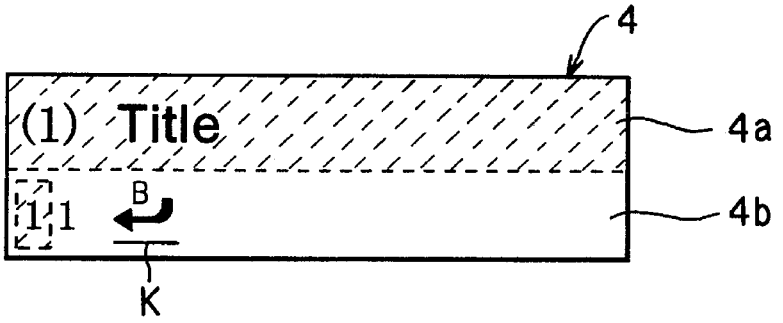
FIG. 36 shows an example of an image displayed on the display during the prompt display routine of FIG. 17.
Figure 37:
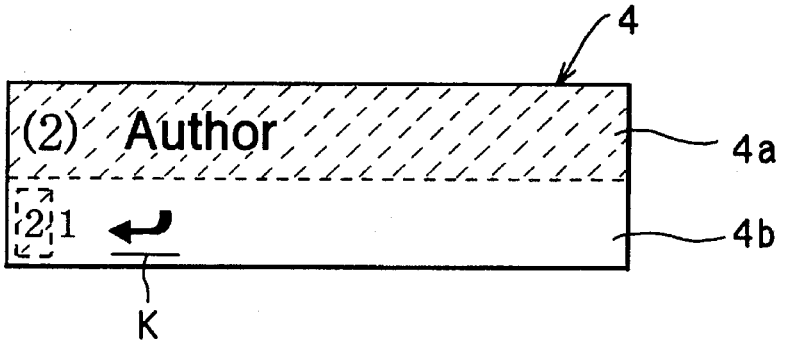
FIG. 37 shows an example of an image displayed on the display during the prompt display routine of FIG. 17.

As in the example shown in FIG. 36, this results in the first prompt "Title" being displayed in the upper display region 4a of the display 4 and the corresponding line layout data including a return block code being displayed in the lower display region 4b. When the move cursor down key or the return line key is depressed, as in the example shown in FIG. 37, the second prompt "Author" is displayed in the upper display region 4a of the display 4. While these prompts are being displayed, the user inputs data corresponding to the displayed prompt. This data is stored as text data in the text memory 51 and displayed on the display 4. Additionally, operating the print key prints out the inputted text data based on the overall layout information and the line layout information, thereby producing a tape-shaped label 23 based on data of a registered label name registered by the user.

Next, an explanation of operations to produce a tape-shaped label 23 based on predetermined registration layout information inputted and set by a user will be provided. Registration layout information inputted and set from the keyboard 3 is stored in the registration file memory 55. The registration layout information includes display information and print layout information. The display information is for displaying in the indicated layout a plurality of label names (registered file names) and a plurality of prompts accompanying each label name. The print layout information is made up of overall layout information and layout information for printing in the indicated layout text data inputted as prompted by each prompt.

Because this registration layout information is stored in the registration file memory 55, the plurality of label names can be displayed one after the other on the display 4 using the registered file selection routine. When a label name is selected, the plurality of prompts accompanying each label name are displayed one after the other in the upper display region 4a of the display 4.

Text data inputted as prompted by each of the plurality of prompts corresponding to the selected label name is stored in the text memory 51. The text data stored in the text memory 51 is printed onto the laminate tape 11 based on this line layout information and the overall layout information, resulting in quick and easy production of the tape-shaped label 33 printed with text data. Further, the registered text data is displayed as prompts. Therefore, it is easy for a user to understand what text data needs to be inputted.

Because the registration layout information includes information on the tape width appropriate for each of the plurality of label names, the optimal tape width for the selected label name can be displayed on the display 4. By acting according to information on this displayed image, a user can accurately produce a tape-shaped label 23 from laminate tape 11 with the optimal tape width. Further, each of the plurality of prompts assigned to each selected label name is displayed in the upper display region 4a of the display 4. The text data inputted as prompted by each prompt is displayed in the lower display region 4b of the display 4. As such, the prompts can be displayed separately from the inputted text data and thus text data for many more characters can be displayed across the entire lower display region 4b than was displayed next to the prompt in the same line of display.

While the invention has been described in detail with reference to specific embodiments thereof, it would be apparent to those skilled in the art that various changes and modifications may be made therein without departing from the spirit of the invention, the scope of which is defined by the attached claims.

For example, the overall layout information retrieved from the registration file memory 55 can be stored in the text label name, that is, a registered file name, is selected. Also, a large display 4 can provided capable of displaying five to six lines,at a time, with prompts displayed in two or three lines in an upper display region and the inputted text data displayed in two or three lines of an lower display region. Printing can be performed using a print tape formed from thermally sensitive paper, rather than using the ink ribbon 13. The present invention can also be applied to various tape-shaped label producing devices that have a keyboard, a CRT-type display and a print mechanism.

According to the present invention, when one of the label names displayed one after the other on the display 4 is selected, the prompts for the selected label name are displayed one after the other on the display 4. The text data inputted as prompted by each of the prompts is stored with print layout information and then printed out on the print tape. Therefore, in order to produce a label, a user need not erase text data inputted to print the preceding tape. Users can quickly and easily prepare a plurality of labels in a desired layout based on registered layout information he or she inputs and sets. Because the prompts are displayed one after another, the user can easily understand what text data needs to be inputted.

Further, the tape can be exchanged with a tape having a different tape width. The registration layout information includes tape width information appropriate for each of the plurality of label names. Therefore, the tape width optimally appropriate for the selected label name can be displayed on the display. A label made from a tape having the optimal tape width can be accurately produced using prompts on the display.

When default data is present, the text data input line is displayed with the default data. Therefore, users need not input the default data, thereby facilitating input of text data.

When default data is present in the display of a prompt and the text data input line associated with the prompt, the cursor is displayed at a position on the text data input lane as determined by the default data. For example, in the case of default data "Min.," the cursor would be positioned in front of "Min." so that the number of minutes could be inputted without first moving the cursor. In other cases, however, it might be advantageous to have the cursor indicate a position after or between sections of the display of the default data.

Tape width information also stored with the layout information, the tape width information can also be displayed with display of the label name.

Also, if the tape printer has a mechanism for detecting the tape width of the tape in mounted tape cassette, the tape printer can be designed not to display label names which require a tape width other than the tape in the detected tape cassette. As a result, a desired label can be quickly and easily produced using the type with width appropriate for the label.

Because registration layout information can be stored in a manner similar to the format information, labels can be produced according to the data of the registered label names on a tape of tape with based on the tape width information.

What is claimed:

1. A tape-shaped label producing device comprising:

input means for inputting a variety of data and commands;

display means for displaying images;

print means for printing on a tape-shape printing medium;

control means for controlling said input means, said display means, and said print means;

layout information memory storing a plurality of label names among which a label name is selectable by an operator, display information regarding input instructing messages for instructing the operator to input text data through said input means following each of the input instructing messages, and print layout information regarding a print layout of the text data inputted by the operator; and display control means for displaying on said display means, based on commands inputted through said input means and based on the display information stored in said layout information memory, the plurality of label names sequentially and for displaying on said display means the plurality of input instructing messages associated with a selected label name, said display control means including indicating means for indicating a portion of said display means into which the text data is inserted following the input instructing messages.

2. A tape-shaped label producing device as claimed in claim 1, wherein said layout information memory stores default information relative to a preselected input instructing message, and wherein said display control means displays on said display means the default information in the portion of said display means following the preselected input instructing message.

3. A tape-shaped label producing device as claimed in claim 2, wherein said indicating means comprises a cursor displayed on said display means.

4. A tape-shaped label producing device as claimed in claim 3, wherein while the input instructing message and the portion of the display means are displayed on said display means, said display control means displays the cursor on said display means at a predetermined portion of said display means.

5. A tape-shaped label producing device comprising:

input means for inputting a variety of data and commands;

display means for displaying images;

print means for printing on a tape-shape printing medium;

control means for controlling said input means, said display means, and said print means;

layout information memory storing a plurality of label names among which a label name is selectable by an operator, display information regarding input instructing messages for instructing the operator to input text data through said input means following each of the input instructing messages, and print layout information regarding a print layout of the text data inputted by the operator;

display control means for displaying on said display means, based on commands inputted through said input means and based on the display information stored in said layout information memory, the plurality of label names sequentially and for displaying on said display means the plurality of input instructing messages associated with a selected label name; and a text memory storing the text data inputted through said input means in association with each input instruction message displayed with respect to the selected label name, wherein the print layout information for printing the text data is retrieved from said layout information memory and the test data is stored in said text memory in association with the print layout information.

6. A tape-shaped label producing device as claimed in claim 5, further comprising tape discriminating means for discriminating tape-shape printing mediums having different widths, and wherein the registration layout information includes information on a width of the tape-shaped printing medium most appropriate for each of the plurality of label names.

7. A tape-shaped label producing device as claimed in claim 6, wherein said display means has a first display portion and a second display portion separate from said first display portion, and wherein said display control means displays each of the plurality of input instructing messages associated with the selected label at the first display portion of said display means, and text data associated with each input instructing message at the second display portion of said display means upon retrieving the text data from said text memory.

8. A tape-shaped label producing device comprising:

input means for inputting a variety of data and commands;

display means for displaying images;

print means for printing on a tape-shape printing medium;

control means for controlling said input means, said display means, and said print means;

layout information memory storing a plurality of label names among which a label name is selectable by an operator, display information regarding input instructing messages for instructing the operator to input text data through said input means following each of the input instructing messages, print layout information regarding a print layout of the text data inputted by the operator, and tape width information on a width of the tape-shaped printing medium most appropriate for each of the plurality of label names; and display control means for displaying on said display means, based on commands inputted through said input means and based on the display information stored in said layout information memory, the plurality of label names sequentially and for displaying on said display means the plurality of input instructing messages associated with a selected label name, said display control means including indicating means for indicating a portion of said display means into which the text data is insertable following the input instructing messages.

9. A tape-shaped label producing device as claimed in claim 8, further comprising mounting means for mounting the tape-shape printing medium, and tape width detection means for detecting width of the tape-shape printing medium mounted in said mounting means, and wherein said display control means selectively displays on said display means only label names appropriate for the tape width detected by said tape width detection means.

10. A tape-shaped label producing device as claimed in claim 9, further comprising a registration layout information memory storing registration layout information which is inputted from said input means and which corresponds to the display information end the print layout information stored in said layout information memory.

11. A tape-shaped label producing device as claimed in claim 8, further comprising mounting means for mounting the tape-shape printing medium, tape width detection means for detecting width of the tape-shape printing medium mounted in said mounting means, end selection prevention means for preventing, while the label name is displayed on said display means, selection of a label name from said registration layout information memory when the tape width detected by said tape width detection means is not appropriate for the label name.

12. A tape-shaped label producing device as claimed in claim 11, wherein said display control means displays, on said display means, tape width information stored in association with the label name when the label name is prevented from being selected.

* * * * *